US006578331B1

(12) United States Patent
Leslie et al.

(10) Patent No.: US 6,578,331 B1
(45) Date of Patent: Jun. 17, 2003

(54) HOUSE WITH STRUCTURAL WATER VAPOR BARRIER

(75) Inventors: Robert H. Leslie, Edina, MN (US); Robert J. Leslie, Richfield, MN (US)

(73) Assignee: International Building Concepts, Ltd., Anoka, MN (US)

( * ) Notice: Subject to any disclaimer, the term of this patent is extended or adjusted under 35 U.S.C. 154(b) by 0 days.

(21) Appl. No.: 09/156,349

(22) Filed: Sep. 18, 1998

Related U.S. Application Data

(63) Continuation-in-part of application No. 08/796,667, filed on Feb. 5, 1997, now Pat. No. 6,035,594.
(60) Provisional application No. 60/011,265, filed on Feb. 7, 1996.

(51) Int. Cl.[7] ..... E04B 1/10; E04B 1/76
(52) U.S. Cl. ..... 52/265; 52/262; 52/270
(58) Field of Search ..... 52/262, 264, 270, 52/79.1, 265

(56) References Cited

U.S. PATENT DOCUMENTS

| | | | | |
|---|---|---|---|---|
| 2,600,900 A | | 6/1952 | McNeill | |
| 2,653,356 A | * | 9/1953 | Brannon | 52/262 |
| 2,996,157 A | | 8/1961 | Rauth | |
| 3,299,594 A | | 1/1967 | Kellert | |
| 3,738,083 A | | 6/1973 | Shimano | |
| 3,919,819 A | | 11/1975 | Oliver | |
| 3,921,355 A | | 11/1975 | Pennecot | |
| 4,001,986 A | | 1/1977 | Kozak | |
| 4,055,924 A | * | 11/1977 | Beaver, Jr. | 52/264 |
| 4,082,356 A | | 4/1978 | Johnson | |
| 4,272,930 A | | 6/1981 | Foster | |
| 4,464,877 A | | 8/1984 | Gebhardt et al. | |
| 4,467,585 A | | 8/1984 | Busby | |
| 4,523,418 A | | 6/1985 | McLaughlin | |
| 4,569,664 A | | 2/1986 | Giampetruzzi et al. | |
| 4,584,805 A | * | 4/1986 | Meiry | 52/264 |
| 4,630,418 A | | 12/1986 | Degut | |
| 5,072,554 A | | 12/1991 | Hayman | |
| 5,323,584 A | * | 6/1994 | Scarlett | 52/729.4 |
| 5,351,453 A | * | 10/1994 | Leslie | 52/270 |

FOREIGN PATENT DOCUMENTS

| | | |
|---|---|---|
| CA | 477325 | 2/1951 |
| DE | 3512306 | 10/1986 |
| FR | 534446 | 1/1922 |

OTHER PUBLICATIONS

Home Builders International, Rendering of 600 Square Foot UniHome, Dec., 1994, Home Builders International, Minneapolis, USA.

Home Builders International, "UniHome: Assembly Manual," Shelter Series, Home Builders International (Minneapolis), (1994).

* cited by examiner

*Primary Examiner*—Michael Safavi
(74) *Attorney, Agent, or Firm*—Haugen Law Firm PLLP

(57) ABSTRACT

An integral and structural wall panel for a generally studless house where the wall panel is in effect the stud (instead of a two inch by four inch piece of dimensional lumber being the stud) and where the wall panel is a vapor barrier (instead of the polyethylene sheet being the vapor barrier). The wall panel runs integrally, or as generally one-piece, from end to end of an exterior wall, from the top to bottom of an exterior wall, and from face to face of the exterior wall, thereby directly transmitting load from end to end, top to bottom, and from face to face and thereby minimizing joints where vapor leakage may occur. The wall panel is generally impervious to water vapor even though formed of an organic material such as wood, preferably oriented strand board, rendering a polyethylene or metallic water vapor barrier optional. Embodiments of the invention include a) a wall panel (about 7/16 inches or one-half inch thick) that includes a support network on each face of the wall panel (with the support network on each face having a thickness of about 7/16 inches or about one-half inch), b) a one-piece sandwich wall panel without a support network and being at least 1.3 inches thick, and c) an integral wall panel without a support network and being at least 1.3 inches thick.

13 Claims, 13 Drawing Sheets

HOUSE WITH STRUCTURAL WATER VAPOR BARRIER

This application is a continuation-in-part of U.S. patent application Ser. No. 08/796,667 filed Feb. 5, 1997 now 6,035,594 and entitled Prefabricated Wall Partition Arrangement, which claims the benefit of U.S. Provisional Patent Application Ser. No. 60/011,265 filed Feb. 7, 1996.

BACKGROUND OF THE INVENTION

The present invention relates generally to houses, more particularly to studless houses, specifically to structural wall panels for studless houses where such panels are water vapor barriers as well as being structural panels, and even more specifically to such studless houses where such panels are formed of oriented strand board.

The Leslie U.S. Pat. No. 5,351,453 issued Oct. 4, 1994 and is entitled Rapidly Erectable Housing Units. The disclosure and claims of this patent generally relate to interlocking connections, such as mortise and tenon structures, between two adjoining walls of the housing unit. This patent does not teach how to make the walls of the housing unit, but some suggestions exist as to how to make the walls. For example, the vertical lines of FIG. 3 of this patent show that the outside walls of the housing unit are formed of sections, instead of being formed from one-piece. Further, the patent states that "the primary portions of the walls may be relatively thin in cross-section with additional strength being obtained through an appropriate header and if necessary base plate addition." FIGS. 1 and 2 of this patent show headers on the exterior walls. The patent also discloses that "such wall panels, headers and the like may be formed by using local material such as grasses, wood particles and various water resistant materials and even pressed to their flat condition through the use of relatively primitive practices such as positioning the material on a flat surface and thereafter covering the positioned material with another flat surface and pressing the same through any available weight. Obviously such processes may only find their applications in isolated areas and, perhaps, areas of particularly low income but this aspect is of import in considering the worth of any invention."

In contrast to the embodiment of the present invention that includes headers, baseboards and firring strips on either face of an integral structural wall panel, the Leslie U.S. Pat. No. 5,351,453 does not teach that such integral structural wall panel runs from end to end of one wall of the house and that such integral structural wall panel runs from the bottom of the wall to the top of the wall. In short, the integral structural wall panel of the present invention is the wall of the house, with the headers, baseboards and firring strips making up a support arrangement for the integral wall panel. Advantages stem from the inclusion of a wall panel that is integral from end to end and from top to bottom. For example, water vapor permeance is minimized.

The Leslie U.S. Pat. No. 5,351,453 further does not teach another embodiment of the present invention. This embodiment includes a relatively thick structural wall panel without the support arrangement of headers, baseboards and firring strips. This embodiment further minimizes water permeance because the wall panel here is, critically, at least about 1.3 inches thick. By the inclusion of a wall panel that is integral from end to end and from top to bottom, that is at least 1.3 inches thick, and that is formed of oriented strand board, a wall having a super low water vapor permeance, perhaps of at or less than about 0.1 perms, is obtained. The thickness of 1.3 inches further provides critical load functions. This embodiment includes two species: one species is formed of three layers of oriented strand board where each layer is about $7/16^{th}$ inches thick (for a total thickness of more than 1.3 inches) and is integral from end to end and from top to bottom, and the other species is preferably only one layer at least 1.3 inches thick so as to be integral from face to face as well as being integral from end to end and from top to bottom.

Still further, the Leslie U.S. Pat. No. 5,351,453 does not teach the problems associated with conventional studded walls or associated with exterior walls which are put together in sections. Conventional, studded walls and sectioned walls are full of defects which allow heat to flow around and through insulation. Some of these defects are insulation voids, thermal bridges, air leaks, air intrusion, convective loops, and moisture.

An insulation void is an area where insulation has been left out. For example, if three percent of a wall is not covered by insulation, the R-value is purportedly reduced 17 percent. If five percent of a wall is not covered by insulation, the R-value is purportedly degraded by 25 percent. With the studless wall panel of the present invention, it is relatively easy to cover such a flat wall panel with insulation. Since it is relatively easy to cover the studless flat wall panel, it is less likely that the wall panel will have voids.

Thermal bridges are points or components that penetrate or bridge through the insulation layer. Studs act as thermal bridges, conducting heat around the insulation and through the wall. Top plates, bottom plates, corner framing, and window and door headers and frames also act as thermal bridges, but the stud is the main thermal bridge culprit.

Air intrusion is air leakage through a house. Air leakage may be infiltration or exfiltration. Air leakage is unintentional air flow. Ventilation is intentional air flow. One way to minimize air leakage is to enclose the house in a vapor barrier envelope, such as polyethylene sheeting. A house may be a "superinsulated" house where such house has an envelope of plastic sheeting which is a water vapor barrier. When such plastic sheeting is stretched between studs, and is often ripped by subcontractors and must be patched. Sectioned walls have leakage between the sections.

A convective loop defect is a channel or bypass that carries air from relatively warm to relatively cold locations. One type of convective loop is caused by the stud. The conventional way to install foil-backed fiberglass insulation is to staple it to the sides of the studs, creating an air space between the foil and the inner wall surface. This creates a channel through which air can flow up and circulate around the insulation, carrying heat with it. The present studless home therefore eliminates a common convective loop.

Moisture is problematic for at least two reasons. First, when any insulation becomes wet, it becomes less effective thermally. Second, wood and other materials, including insulation, may be damaged even after the wood, other material, or insulation dries out. Convection, a defect caused mainly by studs, in turn causes most moisture problems. Warm interior air leaks through the walls of a house, then cools and condenses when it reaches a relatively cool portion of the house. Convection is reduced or eliminated by a vapor barrier. One such vapor barrier is the wall panel of the present invention with or without a conventional vapor barrier such as polyethylene sheeting. The embodiment of the present invention having one wall panel of about 7/16 inch in thickness and having the support network of headers, baseboards and firring strips includes a permeance value of about 1.95 perms. The embodiment of the present invention represented by the sandwich panel having three panels of a 7/16 inch thickness (for a total thickness of about 1.3 inches) is projected to have a permeance value of about 0.5 perms. The embodiment of the present invention represented by the integral wall panel that has a thickness of at least 1.3 inches is projected to have a permeance value of about polyethylene sheeting, i.e. at or less than 0.1 perms. Any material with a permeance of less than 0.1 perms is considered to be a vapor retarder or vapor barrier effective for a superinsulated house.

It should be noted that the embodiment of the present invention represented by the wall panel having the support network of headers, baseboards and firring strips in practice attains a permeance value at or better than polyethylene sheeting even though such wall panel may be only about 7/16 inch thick. This is because polyethylene is easily torn or punctured by subcontractors and, subsequently, by the home owner who most probably is not aware of such a feature in the wall. Oriented strand board (or another material that consists essentially of one material, is formed or an organic matter, is capable of transmitting loads between a base and a roof, and is capable of receiving and holding pin connectors such as nails and screws) is not easily torn.

Oriented strand board is a mat-formed panel made of strands sliced in the long direction from small diameter, fast growing round wood logs and bonded with an exterior-type binder under heat and pressure. The fast growing trees include aspen poplar, southern yellow pin. The basic steps for making oriented strand board include a) slicing the logs into strands along the direction of the grain, b) drying and sorting the strands, c) mixing the dried and sorted strands with wax and a waterproof exterior-type binder such as phenolic or isocyanate resin binder, d) orienting the strands by electrical alignment or mechanical alignment, with each layer of strands being laid down separately along a conveyor belt to result in a "mat" which is loosely held together and has no strength, e) sawing the loose mat into lengths and running the loose through a prepress to remove some air and vapor to escape, f) pressing and heating the mat to a specified thickness to cause the resin to cure and to cause an interweaving or tangling of the strands, and g) permitting the pressed mat to cool. The strength of the oriented strand board product is a result of the uninterrupted fiber, interweaving of the strands, and the orientation of the strands.

Oriented strand board is a wood product and hence reacts to moisture or to changes in moisture. At the same time, oriented strand board includes a waterproof and boilproof binder that is preferably a thermosetting adhesive binder which when fully cured is not softened by moisture or heat. These binders, such as phenol formaldehyde and isocyanate binders, are insoluble heat-resistant polymers that resist aging, moisture and chemical degradation. Permeability of a panel of oriented strand board, or the rate that moisture passes through the panel under stated conditions of moisture vapor pressure, is proportional to the density, degree of orientation and thickness of the panel. According to the pamphlet "OSB Performance By Design," copyright 1996 by the Structural Board Association, printed in Canada, the vapor permeance (in perms) of oriented strand board with nominal panel thicknesses of 3/8 inches, 7/16 inches, 1/2 inches and 5/8 inches is 2.55, 1.95, 1.55 and 1.1, respectively. This pamphlet further states that panel thicknesses of greater than 5/8 inches were not tested, but that it can be assumed that panels having a thickness greater than 5/8 inches, such as 3/4 inches, provide a permeability resistance equal to or better than that of 5/8 inch panels.

The above-noted pamphlet "OSB Performance By Design" indicates that the most common thicknesses of oriented strand board panels are 1/4 inches, 3/8 inches, 7/16 inches, 15/32 inches, 1/2 inches, 19/32 inches, and 23/32 inches and that other panel thicknesses include 7/8 inches, 1 and 1/8 inches, and 1 and 1/4 inches. The pamphlet states that the Structural Board Association discourages the use of nailed in place ordinary oriented strand board wall sheathing alone in load bearing rim joist applications. The pamphlet does not teach using an integral panel of oriented strand board as a wall panel where the wall panel is used as the stud or in place of a plurality of studs and where such panel includes a support network or arrangement of headers, baseboards and firring strips. Nor does the pamphlet teach using an integral panel of oriented strand board as a wall panel where the wall panel is, critically, at least 1.3 inches such that the support network of headers, baseboards and firring strips is eliminated.

SUMMARY OF THE INVENTION

A feature of the present invention is a house having an integral wall panel running from end to end and from top to bottom of each of the exterior walls. Since the wall panel is integral, air and water vapor leakage is minimized.

Another feature of the present invention is that such integral wall panel is structural. Since the wall panel is structural, the use of studs is eliminated or minimized. Since the wall panel is structural, the never-ending search for "centers" is eliminated. Implements and interior walls may be affixed to almost anyplace, if not every place, on the integral structural wall panel.

Another feature of the present invention is that the wall panel is formed of essentially only one material from end to end and from top to bottom.

Another feature of the present invention is that the one material is, preferably, oriented strand board.

Another feature of the present invention is a support network of baseboards, headers, and firring strips added to each of the faces of the integral structural wall panel.

Another feature of the present invention is an oriented strand board wall panel that eliminates the support network of headers, baseboards and firring strips and that includes a critical thickness of at least about 1.3 inches. Two embodiments spring from this feature. One embodiment includes a sandwich wall panel formed of three layers of oriented strand board, with each layer being about 7/16 inch thick. Another embodiment is integral from face to face as well as being integral from end to end and from top to bottom. These two embodiments, especially the second embodiment where the 1.3 inch thick panel is one-piece, provide a super low permeance to air and water vapor.

An advantage of the present invention is that the labor cost of building a home is minimized. Steps that are eliminated include the step of manufacturing the wall sections, the step of teaching others how to join the wall sections on site, the actual step of joining the wall sections on site, and the step of sealing the joints between the wall sections.

Another advantage of the present invention is that a house having the oriented strand board wall panels may be built quickly and easily at low cost. For example, entire walls (not merely wall sections) may be formed in the factory, with doors and windows being cut out at the factory or at the building site.

Another advantage is that the house having the oriented strand board wall panels may be built free of studs. The oriented strand board wall panels themselves act as the studs, with the oriented strand board wall panels supporting the roof structure.

Another advantage is that thermal defects, such as insulation voids, thermal bridges, air leaks, air intrusion, convective loops, and moisture defects, are minimized. Features contributing to this advantage include the wall panel being one-piece and integral so as to minimize wall section joints and further include the wall having a low permeance value.

Another advantage is that the house having the oriented strand board wall panels is strong and exceeds the strength of conventional homes having studs of dimensional lumber.

Another advantage is that the house having the oriented strand board wall panels minimizes or eliminates the need for plastic sheeting or metallic sheeting to keep out moisture. Whether the wall panel is $7/16^{th}$ inches thick with a support network of headers, baseboards and firring strips or whether the wall panel is 1.3 inches thick, such wall panels have an extremely low permeance to water vapor.

Another advantage is that the house having the oriented strand board wall panels complements the plastic or metallic water vapor barrier. These water vapor barriers are extremely thin and are thus easily torn and punctured, defeating the purpose of the water vapor barrier envelope. Oriented strand board 0.5 or 1.3 inches thick is not inadvertently punctured.

These and further objects and advantages of the present invention will become clearer in light of the following detailed description of the illustrative embodiments of this invention described in connection with the drawings.

BRIEF DESCRIPTION OF THE DRAWINGS

The illustrative embodiments may be best described by reference to the accompanying drawings where:

FIG. 6C specifically shows a modified box beam, wall panel and baseboard.

Figure 1:
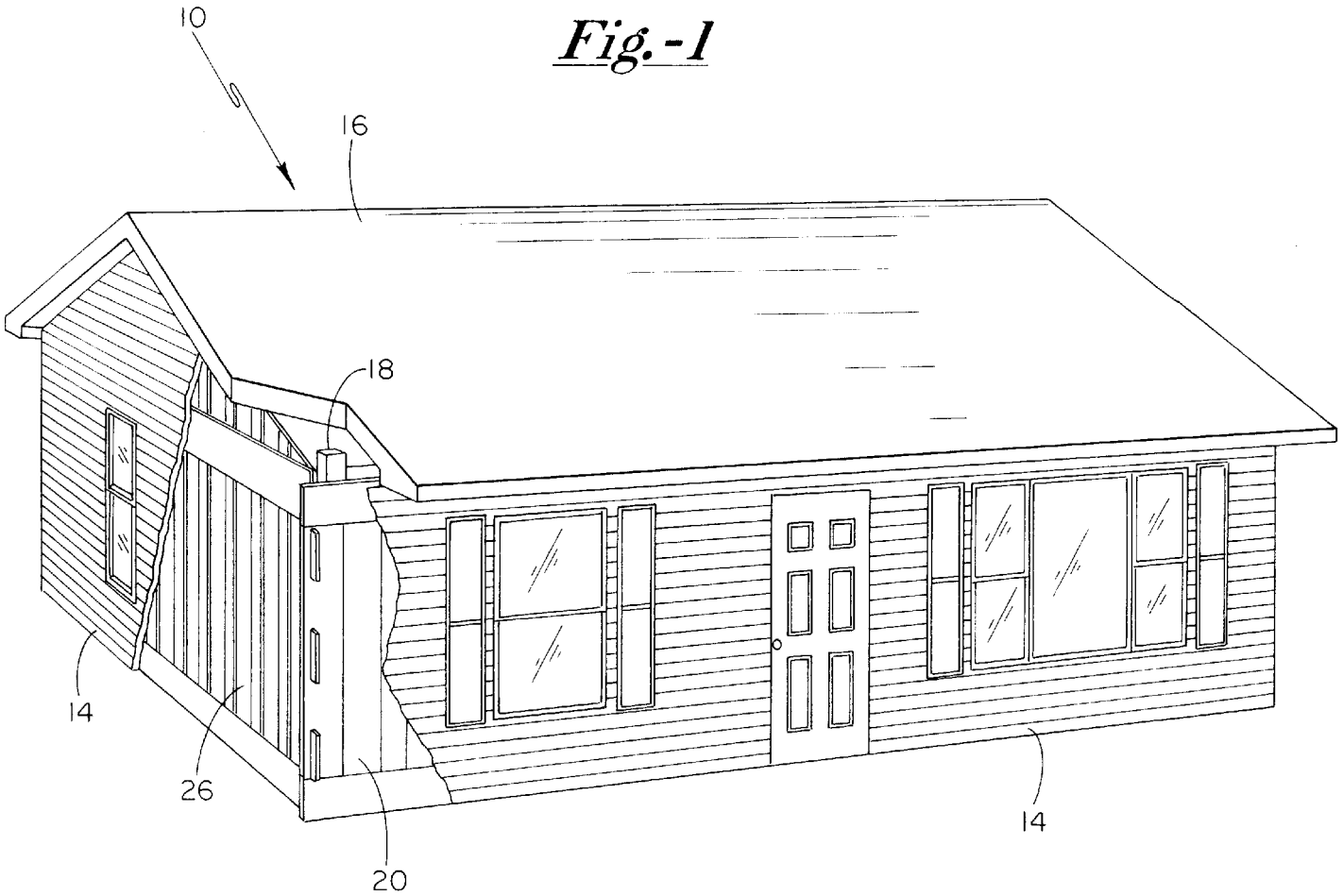
FIG. 1 is a perspective view of the house of the present invention, with the view being partially broken away to show the structural oriented strand board wall panel.

All Figures are drawn for ease of explanation of the basic teachings of the present invention only; the extensions of the Figures with respect to number, position, relationship, and dimensions of the parts to form the preferred embodiment will be explained or will be within the skill of the art after the following description has been read and understood.

DESCRIPTION

FIGS. 1, 2A–C, 3A–C, 4A–C and 5A–C show a house 10 having wall panels 20, 22, 24 and 26 of the present invention. The house 10 includes four walls 14, and each of these walls 14 includes one, and only one, of the wall panels 20, 22, 24 and 26. Wall panels 20, 22, 24 and 26 are structural so as to provide support for the roof 16 and such that load from the roof 16, and any live loads on the roof 16, is transmitted onto each of the wall panels 20, 22, 24 and 26. In contrast to a conventional stud wall, load is transmitted anywhere and everywhere along the length of wall panels 20, 22, 24 and 26. Each of the wall panels 20, 22, 24 and 26 is formed of a material generally impermeable to water vapor, preferably oriented strand board, so as to make an enormous contribution toward making the home 10 airtight and water vapor tight. Each of the wall panels 20, 22, 24 and 26 runs integrally from one end to the other end and from its bottom edge to its upper edge so as to minimize joints in the walls 14 so as to minimize locations that must be sealed against airflow. House 10 includes a blower 18 for ventilation of all interior spaces in the house 10. Each of the wall panels 20, 22, 24 and 26 provides a nail base anywhere along its length or height so as to eliminate a search for studs when implements or additions are to be engaged to the walls 14.

Reference numbers 20, 22, 24 and 26 indicate respectively the front wall panel, the rear wall panel, one side wall panel, and another side wall panel. Each of the wall panels 20, 22, 24 and 26 includes a lower edge 30, an upper edge 32, an end edge 34, an opposite end edge 36, an inner face 38 (shown in FIG. 6C), and an outer face 40. Between the edges 30, 32, between the end edges 34 and 36, and between the faces 38 and 40, each of the wall panels 20, 22, 24 and 26 is integral and consists essentially of oriented strand board. Front and rear wall panels 20 and 22 are eight feet by 48 feet. Side wall panels 24 and 26 are eight feet by 24 feet.

In strict dimensional terms, the width (or length) dimension of wall panels 20, 22, 24 and 26 (and wall panels 120 and 128 noted below) is preferably about 12 to about 60 feet, more preferably about 20 to about 50 feet, and most preferably about 24 to about 48 feet. The height of wall panels 20, 22, 24 and 26 (and wall panels 120 and 128 noted below) is preferably between about 8 to about 12 feet and more preferably between about eight and about 10 feet, and most preferably about eight feet.

In terms of shipment, the width (or length) dimension of wall panels 20, 22, 24 and 26 (and wall panels 120 and 128 noted below) is preferably as long as can be safely shipped cross country on long haul tractor-trailer rigs on the national highway system.

In terms of the height of the average adult male, the height of each of the wall panels 20, 22, 24 and 26 (and wall panels 120 and 128 noted below) is greater than the height of an average adult male. The length of each of the wall panels 20, 22, 24 and 26 (and wall panels 120 and 128 noted below) is preferably greater than the height.

In terms of openings, wall panels 20, 22, 24 and 26 (and wall panels 120 and 128 noted below) are of sufficient length to preferably include a door or window opening, more preferably to include two such openings, and still more preferably to include three such openings.

In terms of corners, each of the wall panels 20, 22, 24 and 26 (and wall panels 120 and 128 noted below) is preferably of sufficient length to extend from a door opening to a corner of the house 10 and more preferably to extend from one corner to another corner of the house 10.

In terms of the house as a whole, the house 10 has four corners. The house 10 preferably has one wall panel 20, 22, 24, 26, 120, or 128 running integrally from corner to corner, more preferably two wall panels 20, 22, 24, 26, 120, or 128 running integrally from respective corner to respective corner, still more preferably three wall panels 20, 22, 24, 26, 120, or 128 running integrally from respective corner to respective corner, and most preferably four wall panels 20, 22, 24, 26, 120, or 128 running integrally from respective corner to respective corner (in the case of a house having generally four sides).

Where the house 10 has modules, wall panels (such as wall panels 20, 22, 24, 26, 120, or 128) preferably extend integrally across each wall of the module.

Wall panels 20, 22, 24, and 26 preferably have a vapor permeance value of between about 0.05 perms and 2.55 perms, more preferably between about 0.05 perms and 2.0 perms, and most preferably between about 0.05 perms and 1.95 perms.

Figure 2A:
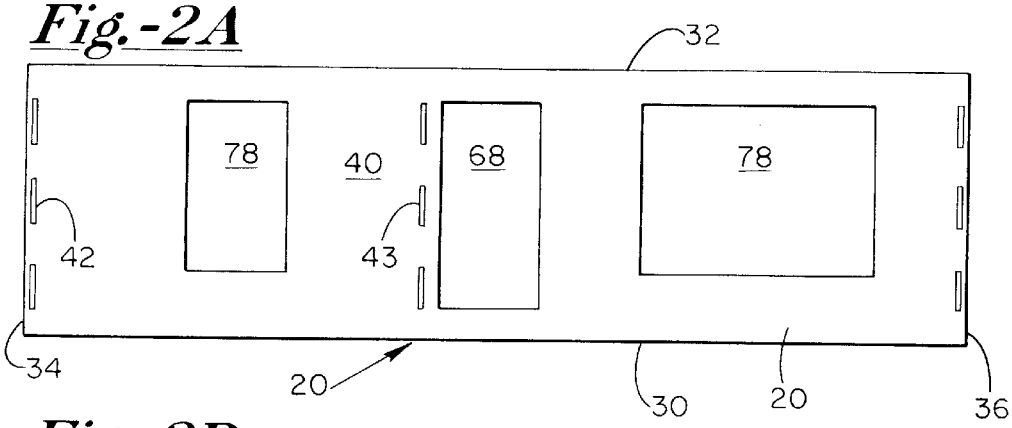
FIG. 2A is an elevation view of the front wall panel of the house of FIG. 1 and shows receptor slots for receiving tongues of adjoining wall panels.
Figure 2B:
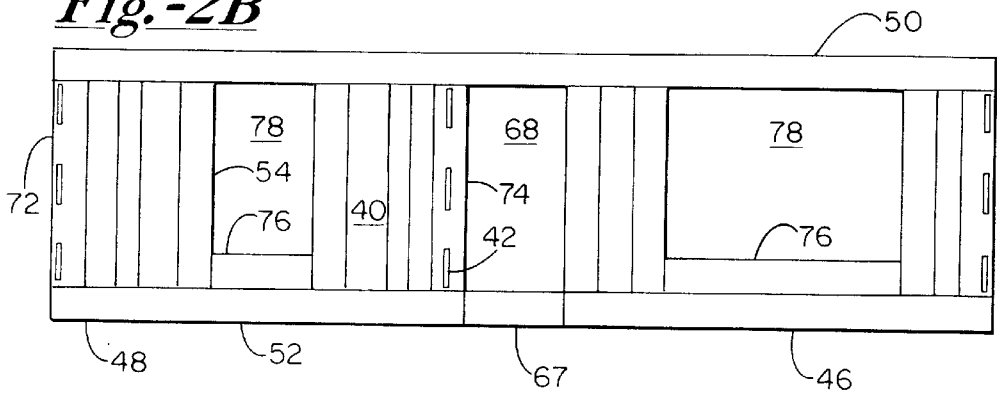
FIG. 2B is an elevation view of the front wall panel of FIG. 2A having headers, baseboards and firring strips placed on the outside surface thereof to provide an even a greater nail base for implements such as window and door frames and to provide receptor slots for tongues of adjoining exterior and interior walls.
Figure 2C:
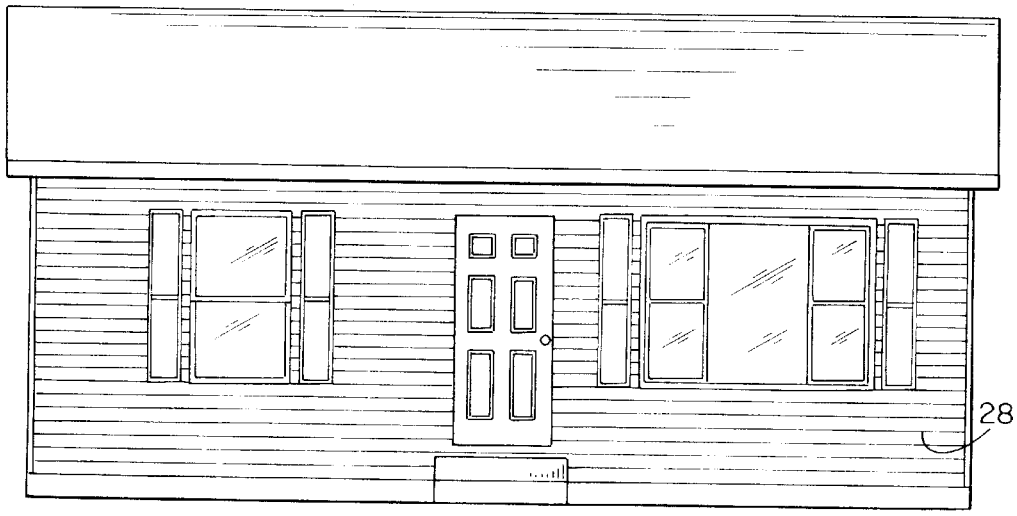
FIG. 2C is an elevation view of the front of the house of FIG. 1 and corresponds to FIGS. 2A and 2B.
Figure 3A:
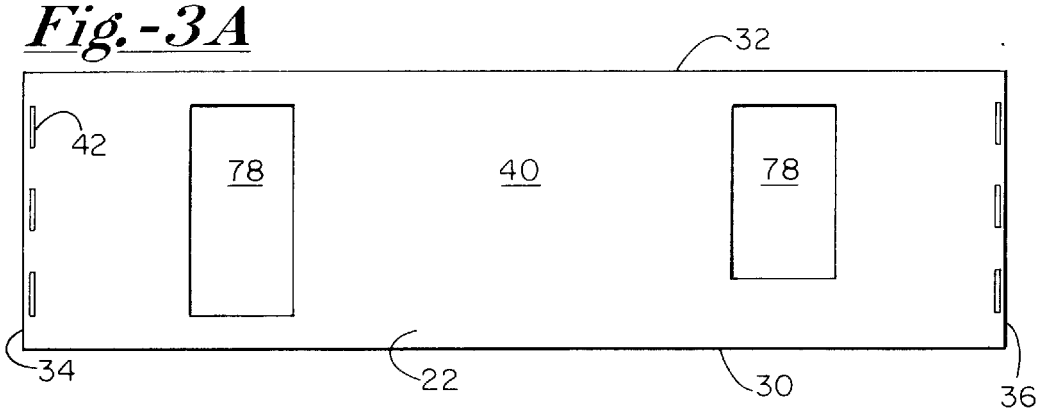
FIG. 3A is an elevation view of the rear wall panel of the house of FIG. 1 and shows receptor slots for receiving tongues of adjoining wall panels.
Figure 3B:
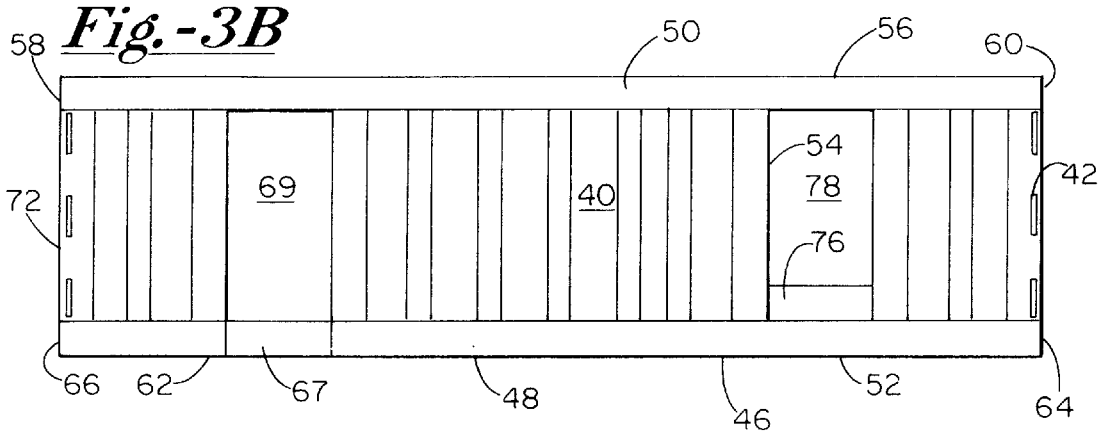
FIG. 3B is an elevation view of the rear wall panel of FIG. 3A having headers, baseboards and firring strips placed on the outside surface thereof to provide an even a greater nail base for implements such as window frames and to provide receptor slots for tongues of adjoining exterior walls.
Figure 3C:
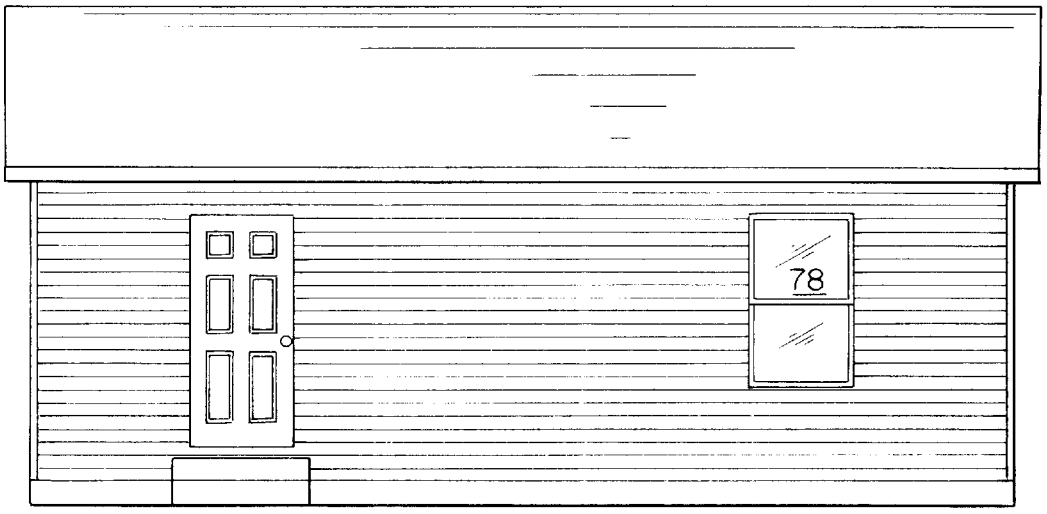
FIG. 3C is an elevation view of the front of the house of FIG. 1 and corresponds to FIGS. 3A and 3B.
Figure 4A:
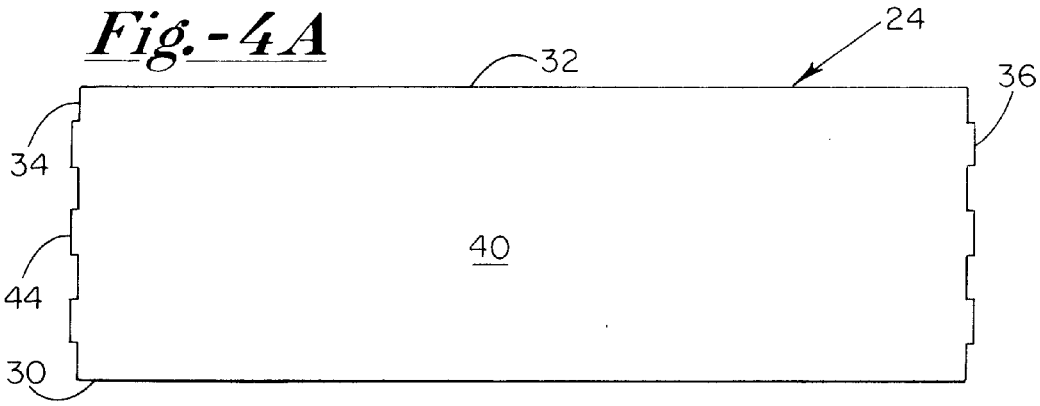
FIG. 4A is an elevation view of a side wall panel of the house of FIG. 1 and shows tongues for engaging the receptor slots of the walls panels of FIGS. 2A and 3A, and further shows receptor slots for engaging tongues of interior wall panels.
Figure 5A:
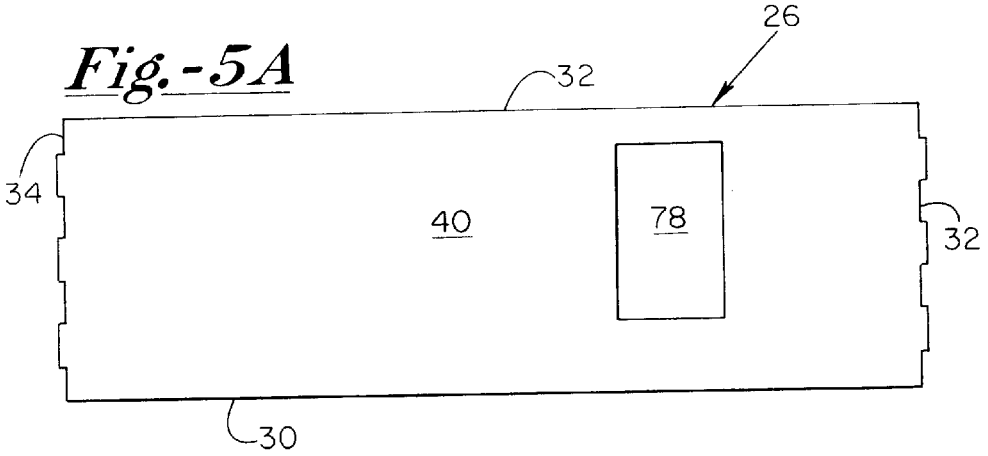
FIG. 5A is an elevation view of the other side wall panel of the house of FIG. 1 and shows tongues for engaging the receptor slots of the walls panels of FIGS. 2A and 3A.

As shown in FIGS. 2A and 3A, the front wall panel 20 and the rear wall panel 22 include tongue or female receptor slots 42 for engaging tongue or male connectors 44 of the side wall panels 24 and 26 (shown in FIGS. 4A and 5A). Each of the receptor slots 42 is spaced inwardly from its respective end edge 34 or 36 and inwardly from the upper and lower edges 30, 32. Each of the receptor slots 42 runs generally vertically. The number of receptor slots 42 may vary, but a minimum number of slots, such as one, two, or three slots 42, is preferred to minimize the number of joints through which air and water vapor may leak. A set of three slots 43 is most preferred. As to such receptors 42 and tongues 44 (or mortises 42 and tenons 44), the Leslie U.S. Pat. No. 5,351,453 is hereby incorporated by reference in its entirety. Slots 43, similar to slots 42, are formed in a medial portion of a wall panel, such as in front wall panel 20 and side panel 24, and engage tongues on interior wall panels.

Each of the wall panels 20, 22, 24 and 26 includes a support arrangement 46 engaged thereto. Support arrangement 46 includes, engaged on each of the inner and outer faces 38 and 40 with pin connectors or adhesive or both, a header, baseboard, and strip combination 48. This combination 48 includes a header 50, a baseboard 52, and firring strips 54 running between header 50 and baseboard 52 and transmitting loads therebetween.

Header 50 includes an upper edge 56 lying flush with upper edge 32 of its respective wall panel 20, 22, 24 or 26. Header 50 includes end edges 58 and 60 lying flush with end edges 34 and 36 of its respective wall panel 20, 22, 24 or 26. Header 50 is integral from end to end, and between its upper and lower edges, and from face to face, and consists essentially of oriented strand board.

Figure 4B:
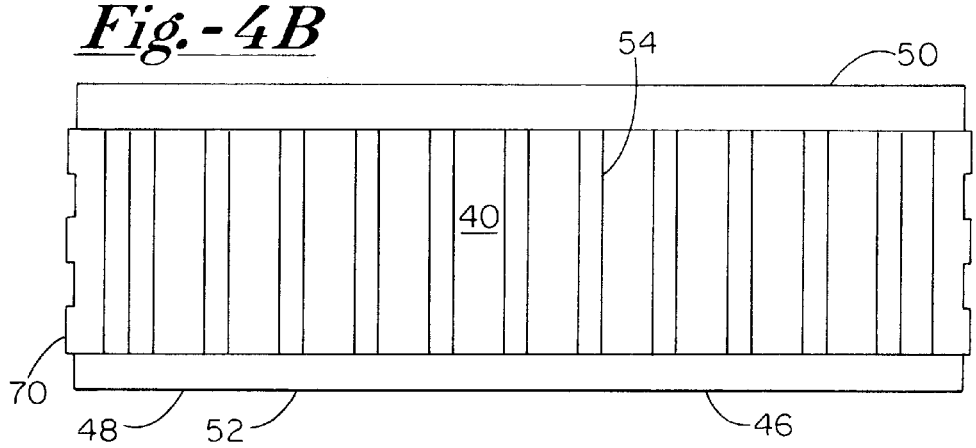
FIG. 4B is an elevation view of the side wall panel of FIG. 4A having headers, baseboards and firring strips placed on the outside surface thereof to provide an even a greater nail base for implements, to provide reinforcement for the receptor slots for the tongues of adjoining interior walls, and to provide further strength to the tongues.
Figure 4C:
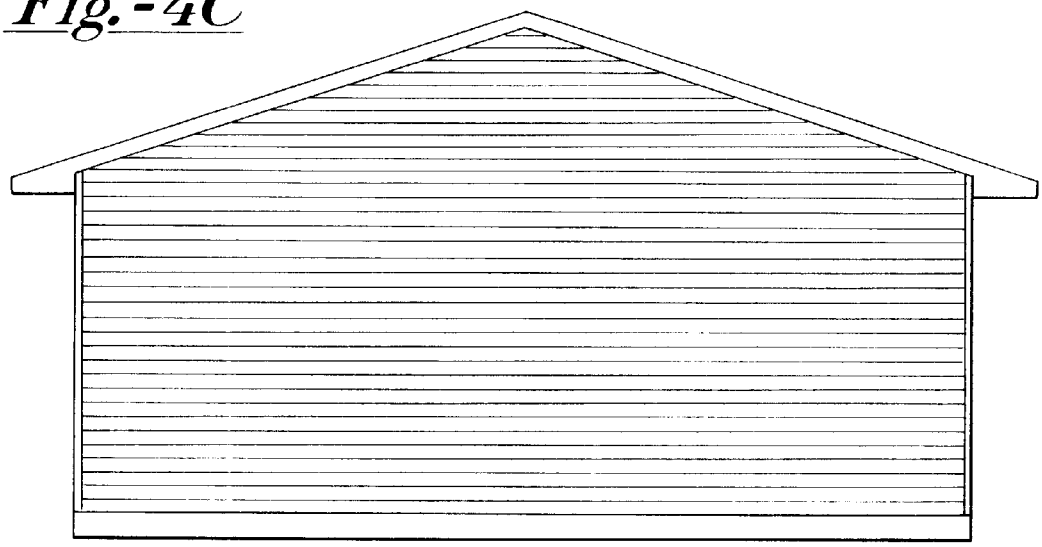
FIG. 4C is an elevation view of one side of the house of FIG. 1 and corresponds to FIGS. 4A and 4B.
Figure 5B:
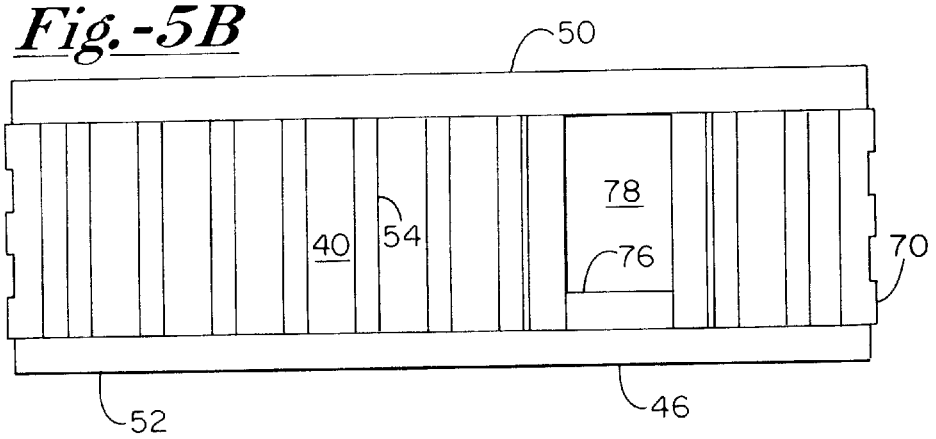
FIG. 5B is an elevation view of the side wall panel of FIG. 5A having headers, baseboards and firring strips placed on the outside surface thereof to provide an even a greater nail base for implements such as window frames and to provide further strength to the tongues.
Figure 5C:
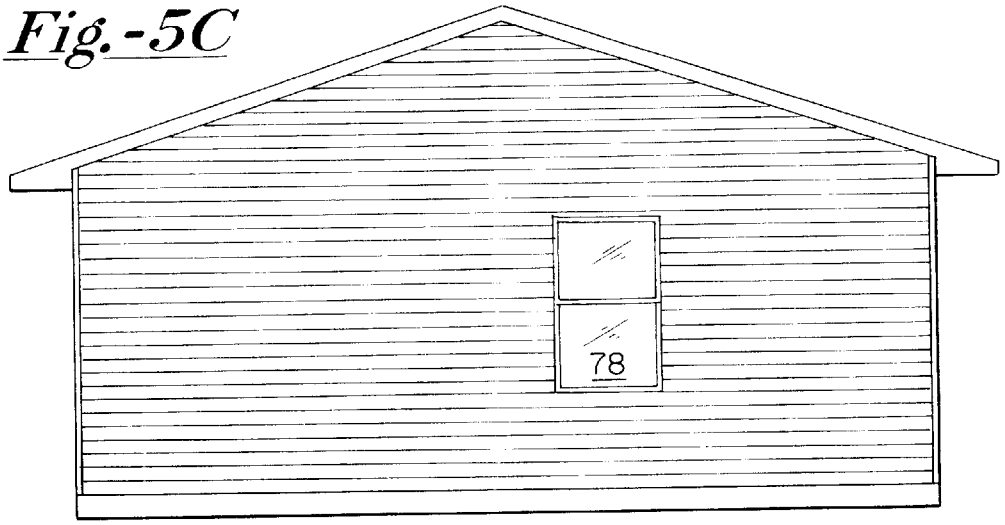
FIG. 5C is an elevation view of the other side of the house of FIG. 1 and corresponds to FIGS. 5A and 5B.

Baseboard 52 includes a lower edge 62 lying flush with lower edge 30 of its respective wall panel 20, 22, 24 or 26. Baseboard 52 includes end edges 64 and 66 lying flush with end edges 34 and 36 of its respective wall panel 20, 22, 24 or 26. Two of the baseboards 52, shown in FIGS. 4B and 5B, are integral from end to end, and between their upper and lower edges, and from face to face. Each of the front and rear baseboards 52, shown in FIGS. 2B and 3B, includes a portion 67 cutout for respective front and rear door openings 68 and 69. Baseboard 52 consists essentially of oriented strand board.

Disposed between header 50 and baseboard 52, and transmitting loads therebetween, is a set of firring strips 54. End firring strips 70 on side wall panels 24 and 26 are cut so as to match the tongues 44 of side wall panels 24 and 26 and to run flush with end edges 34 and 36 of its respective side wall panel 24 or 26. End firring strips 72 on front and rear wall panels 20 and 22 include slots 42 matching the slots 42 of the front and rear wall panels 20 and 22 and so as to run flush with end edges 34 and 36 of its respective front or rear wall panel 20 or 22. Some firring strips 54, such as firring strips 74, include slots 42 for receiving tongues of interior wall panels. Still other firring strips 54 include horizontally running firring strips 76 that may provide support for window frames for window openings 78.

It can therefore be appreciated that the header-baseboard-strip combination 48, engaged to each of the faces 38 and 40 of its respective wall panel 20, 22, 24 or 26, is a support for such wall panels 20, 22, 24 and 26, and transmits load in each of the directions that wall panel 20, 22, 24 and 26 transmits load. In other words, vertical loads upwardly and downwardly are transmitted via the strips 54, horizontal or transverse loads are transmitted across wall panel 12 and to adjoining wall panels 12 via the header 50 and baseboard 52, and horizontal loads may be transmitted between vertical running firring strips via horizontal firring strips such as horizontal firring strips 76. The thickness of each of the wall panels 20, 22, 24 and 26 is, preferably, at least 7/16 inches, more preferably, in the range of about 7/16 inches thick to about 1.25 inches thick and most preferably in the range of about 7/16 inches to about 9/16 inches thick. Each of the headers 50, baseboards 52, and firring strips 54 is about 7/16 inch thick. In other words, the support network 46 on each of the faces of the wall panel 12 is about 7/16 inch thick such that the total thickness of the wall panels and support network (on each face of its respective wall panel) is preferably about 1.3 inches to about 1.5 inches.

As can be appreciated from above, some of the wall panels have openings. These openings include the front and rear door openings 68 and 69, the window openings 78. Further openings are the slots 42. Other openings include openings for pipes for ventilating and plumbing and openings for electrical, cable, telephone, and computer wiring.

Figure 6A:
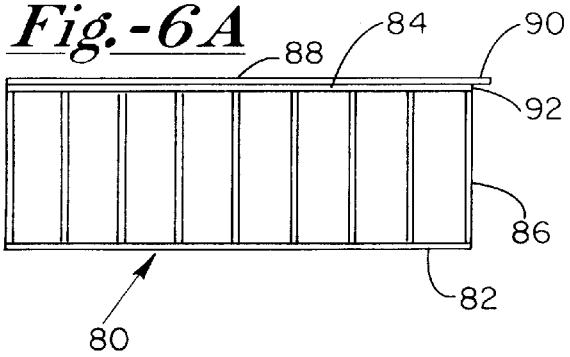
FIG. 6A is a partial view of one type of foundation wall for the house of FIG. 1.

FIG. 6A shows a preferred foundation wall 80. The foundation wall 80 includes a bottom plate 82 and an upper plate 84. Studs 86 run to and between the bottom plate 82 and upper plate 84. A cap plate 88 lies flat on the upper plate 82 and includes an extension portion 90 running beyond an end 92 of upper plate 84. End 92 is tied into a right angle adjoining foundation wall via the upper plate of the adjoining foundation wall. Another foundation wall, a mirror image of foundation wall 80, is placed in line with foundation wall 80 so that extension portion 90 extends to another right angle adjoining foundation wall. Bottom plate 82, upper plate 84, studs 86 and cap plate 88 are preferably two inch by six inch strips of dimensional lumber.

Figure 6C:
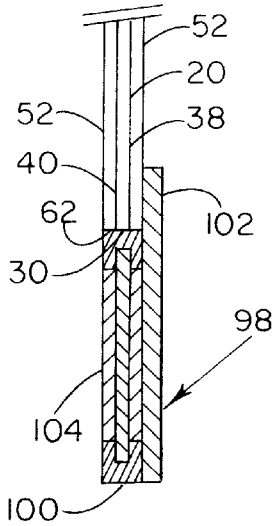
FIG. 6C is a section view of a portion of the floor joist layout of FIG. 6B and a portion of the wall panel having baseboards.
Figure 6B:
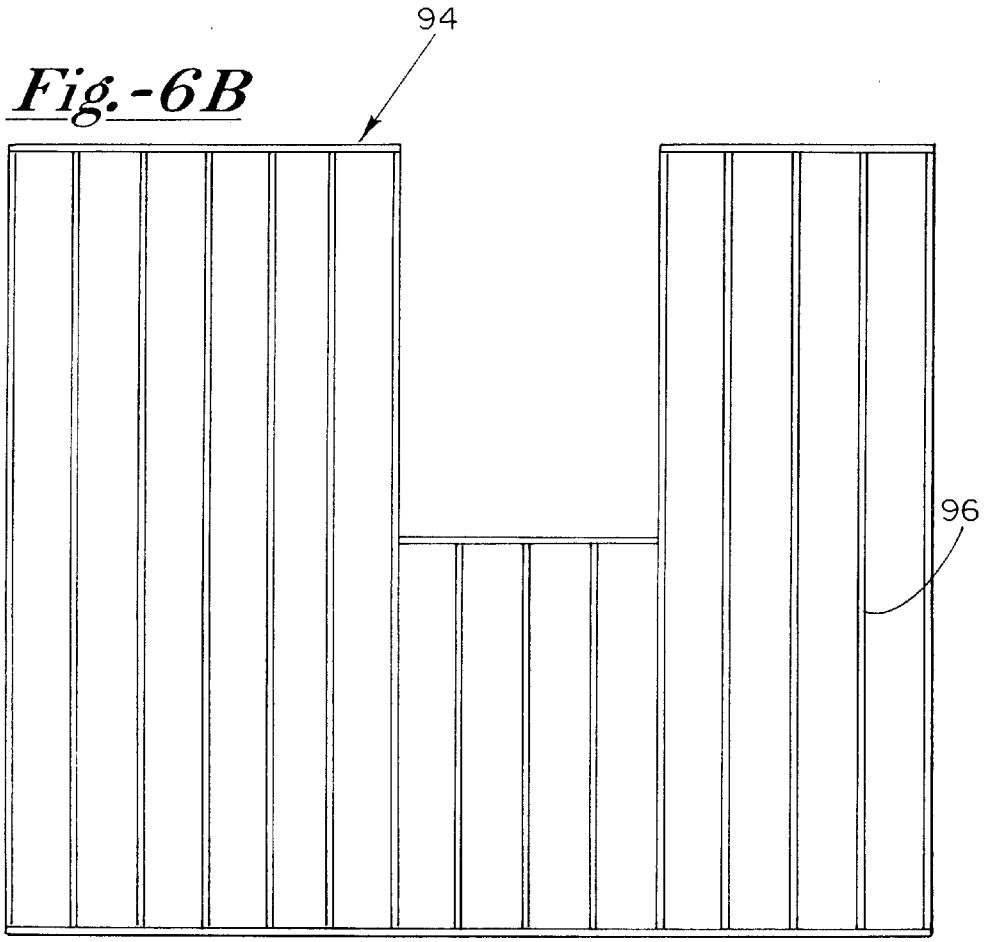
FIG. 6B is a top view of the floor joist layout of the house of FIG. 1.

FIG. 6B shows a floor joist arrangement 94 of house 10. The floor joist arrangement 94 includes a plurality of I-beams 96. As to such a floor joist arrangement 94, parent U.S. patent application Ser. No. 08/794,429 filed Feb. 5, 1997 and entitled Building Jig and Box Beam Therefor is hereby incorporated by reference in its entirety.

Foundation walls 80 are tied into a concrete foundation. Floor joist arrangement 94 in turn rests upon and is tied into the foundation walls 80. Wall panels 20, 22, 24 and 26 in turn rest upon and are tied into the floor joist arrangement 94, as shown in FIG. 6C. Here, a floor joist beam or modified box beam 98 includes an I-beam 100, an extension plate 102 and, optionally, web stiffeners 104. As to such a modified box beams, parent U.S. patent application Ser. No. 08/794,429 filed Feb. 5, 1997 and entitled Building Jig and Box Beam Therefor is hereby incorporated by reference in its entirety. As shown in FIG. 6C, the bottom edge 30 of wall panel 12 and the bottom edges 62 of baseboards 52 rest upon the upper face of the upper flange of I-beam 100, and the outer face of the inner baseboard 52 abuts one face of extension plate 102.

Figure 7A:
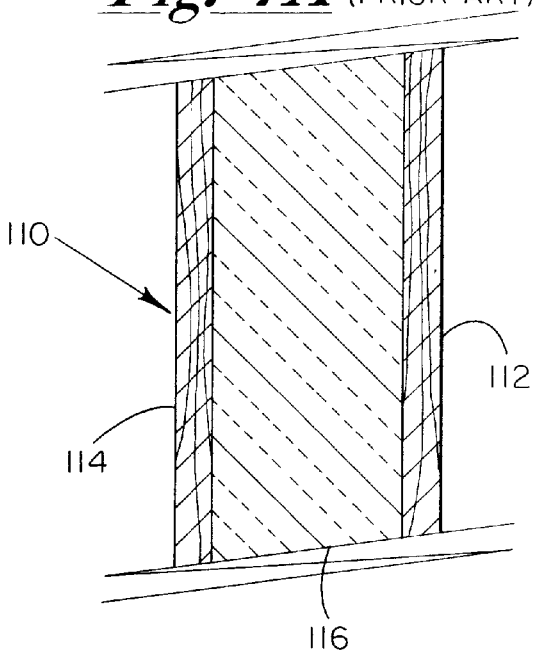
Fig.-7A (PRIOR ART)
FIG. 7A is an end view of a prior art foam core sandwich panel (structural insulated panel, i.e., SIPS).
Figure 7B:
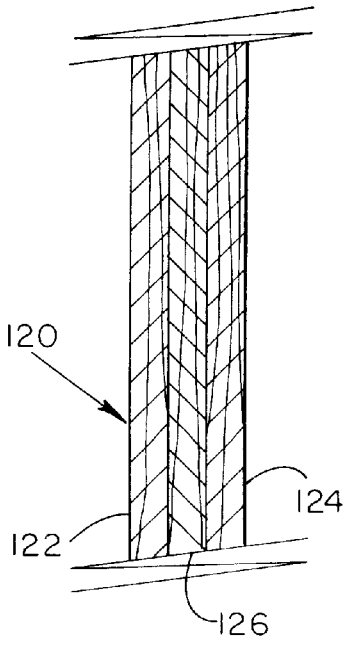
FIG. 7B is a partial end view of another embodiment of the present invention, specifically a sandwich wall panel where the support arrangement (i.e. the header, baseboard, and strip combination) is replaced by a two outer panels of oriented strand board such that the sandwich wall panel includes a core panel of oriented strand board between the two outer panels of oriented strand board, and where the total thickness of the sandwich panel is critically at least 1.3 inches or more.
Figure 7C:
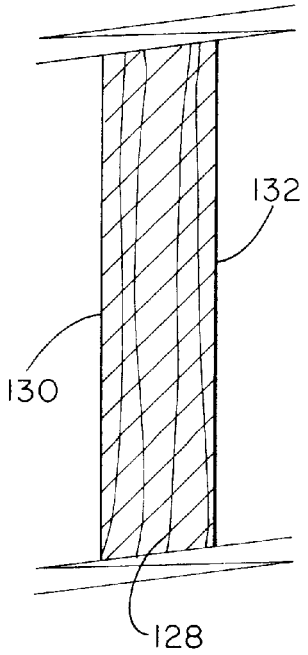
FIG. 7C is a partial end view of another embodiment of the present invention, where the sandwich wall panel is replaced by an integral wall panel, where such integral wall panel is formed of oriented strand board and where the thickness of the integral panel is critically at least 1.3 inches or more.
Figure 8A:
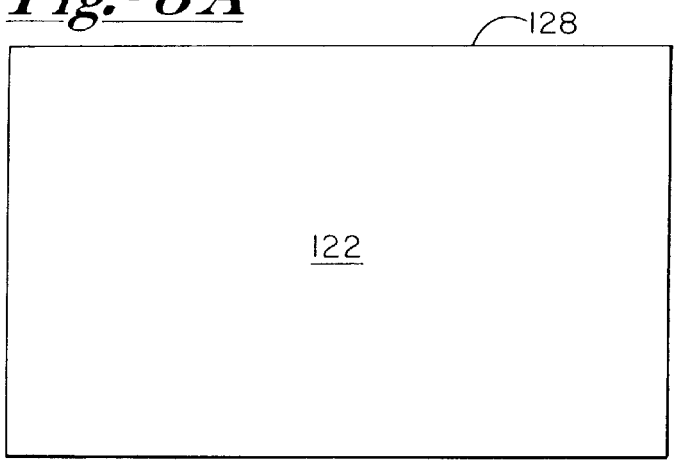
FIG. 8A is an elevation view of the sandwich wall panel of FIG. 7B.
Figure 8B:
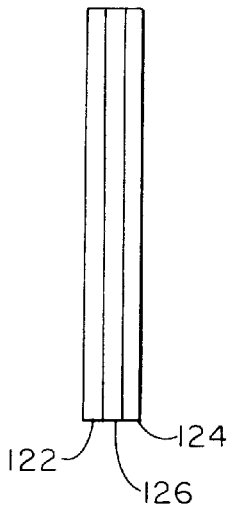
FIG. 8B is an end view of the sandwich wall panel of FIG. 8A.
Figure 8C:
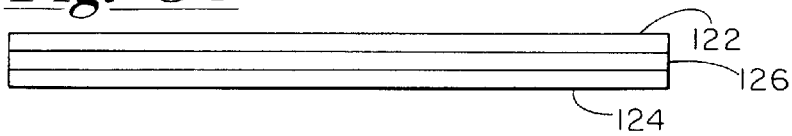
FIG. 8C is a bottom view of the sandwich wall panel of FIG. 8A.
Figure 8D:
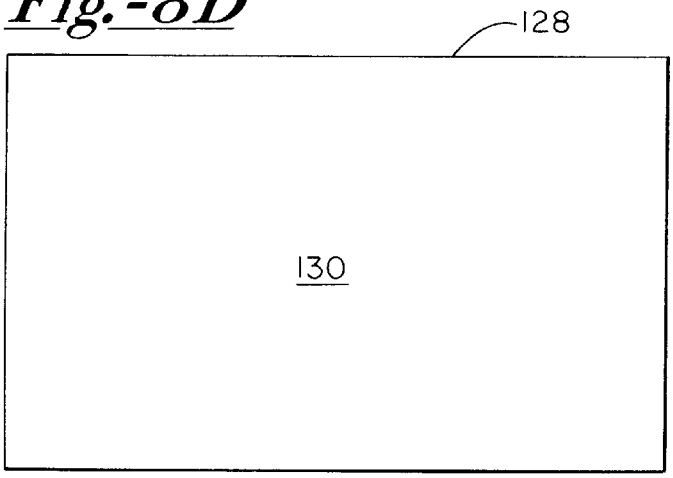
FIG. 8D is an elevation view of the integral wall panel of FIG. 7C.
Figure 8E:
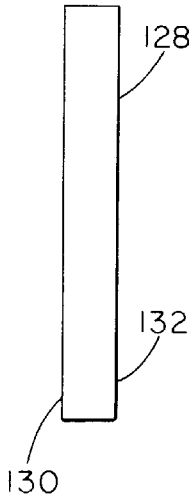
FIG. 8E is an end view of the integral wall panel of FIG. 8D.
Figure 8F:
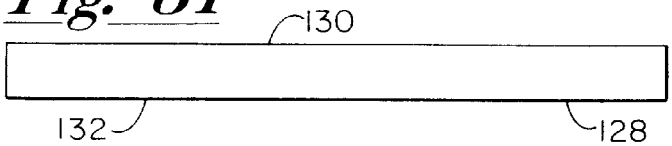
FIG. 8F is a bottom view of the integral wall panel of FIG. 8D.

FIG. 7A shows a prior art foam core sandwich panel 110. The sandwich panel 110 includes a pair of outer panels 112, 114 formed of oriented strand board and a core panel 116 of an insulating foam. Panel 112 may provide the exterior sheathing. Panel 114 may provide the interior sheathing. Core panel 116 may consist of a rigid foam. Panel 110 may be manufactured in sizes from four foot by eight foot to eight foot by twenty-four feet. Sandwich panel 110 may be used in a structural wall, a roof, or a floor. The outer panels 112 and 114 may be glued to either precast or foamed in place rigid cores 116. The thickness of the rigid foam core may be from about 3.5 inches to about 11.25 inches thick.

In one embodiment of the present invention, as shown in FIGS. 7B, 8A, 8B and 8C, a sandwich wall panel 120 includes at least three discrete layers of oriented strand board, namely, a pair of outer layers 122 and 124 and an inner core layer 126. Each of the three layers consists essentially of oriented strand board. Either of the outer layers 122 or 124 may provide the interior sheathing and either of the outer layers 122 or 124 may provide the exterior sheathing. Each of the layers 122, 124 and 126 includes sublayers (such as sublayers 240 and 244 of an aligned face and oriented core shown in FIG. 13 A or such as sublayers 240 and 248 of an aligned face and random core, shown in FIG. 13B). Outer or face layers 122 and 124 replace the support network 46.

In another preferred embodiment of the present invention, as shown in FIGS. 7C, 8D, 8E and 8F, an integral wall panel 128 includes a first face 130 and a second face 132. Integral wall panel 128 consists essentially of oriented strand board from the first face 130 to the second face 132. Integral wall panel 128 includes sublayers (such as sublayers 240 and 244 of an aligned face and oriented core shown in FIG. 13A or such as sublayers 240 and 248 of an aligned face and random core, shown in FIG. 13B).

The present inventors have found that such a sandwich wall panel 120 or such an integral wall panel 128 provides two critical functions at the same time: 1) a low permeance value, which thereby minimizes, or eliminates entirely, the need for a water vapor barrier such as sheet polyethylene; and 2) strength, which thereby minimizes, or eliminates entirely, the need for studs.

The thickness of the sandwich panel 120 or the integral wall panel 128 is, critically, at least 1.3 inches. A thickness of less than 1.3 inches does not provide the permeance required. The thickness of either of the panels 120 or 128 may be greater than 1.3 inches where the load required to be carried by the walls of the intended structure is greater. For example, the thickness of either of the panels 120 or 128 may be increased by increments of, for instance, 7/16 inches, up to twelve inches. Beyond twelve inches, the weight of the wall panel 120 or 128 may be excessive. The thickness of the sandwich panel 20 may be increased by substituting thicker discrete panels or by adding discrete panels so that the number of discrete panels is more than three.

The present inventors are the first to discover a wall panel—forming the backbone of an entire exterior wall of a structure—may be structural from end to end and from top to bottom of the exterior wall, that the same wall panel may be integral from end to end and from top to bottom of the exterior wall, and that the same wall panel may be formed of a material that has a relatively low permeance to water vapor. Preferably, this material is oriented strand board. Accordingly, oriented strand board itself may be used as a vapor retarder or vapor barrier, alone or in combination with another vapor barrier such as polyethylene sheeting. As to permeance, the book Superinsulated Home Book, authored by J. D. Ned Nisson and Michael L. Webb, copyright 1985, published by John Wiley & Sons, New York, is hereby incorporated by reference in its entirety. A permeance value of 1.0 perm means that under a vapor pressure differential of 1.0 inch of mercury, 1.0 grain per hour of water vapor will diffuse through each square foot of surface. One-eighth inch of standard hardboard has a permeance value of 11. One-eighth inch of tempered hardboard has a permeance value of 5. Exterior plywood has a permeance of 0.7. Interior plywood has a permeance value of 1.9. Polyethylene has a permeance value of 0.08, 0.06, and 0.04 for thickness of 4 mil, 6 mil, and 8 mil, respectively. Aluminum foil has a permeance value of 0.0. As indicated above, according to the pamphlet "OSB Performance By Design," copyright 1996 by the Structural Board Association, printed in Canada, the vapor permeance (in perms) of oriented strand board with nominal panel thicknesses of 3/8 inches, 7/16 inches, 1/2 inches and 5/8 inches is 2.55, 1.95, 1.55 and 1.1, respectively. This pamphlet further states that panel thicknesses of greater than 5/8 inches were not tested, but that it can be assumed that panels having a thickness greater than 5/8 inches provide a permeability resistance equal to or better than that of 5/8 inch panels. Any material with a permeability of less than 0.10 perm is considered to be a good air/vapor barrier and is considered to be sufficient for a superinsulated home. The above noted pamphlet does not recognize that such a low permeance may be achieved with oriented strand board panels 1.3 inches or more in thickness. Wall panels 120 and 128 preferably have a water vapor permeance value of between about 0.05 perm and 0.5 perm, more preferably between about 0.05 perm and 0.3 perm, and most preferably between about 0.05 perm and about 0.1 perm.

If a house is airtight and water vapor tight, then the amount of insulation that is required is minimized. Also, if the vapor barrier itself is formed of a material that is insulative, then the amount of insulation that is required is still further minimized. The present inventors have uniquely recognized that oriented strand board is both a vapor barrier and an insulator. Maple, oak, and similar hardwoods have an R value of about 0.91 per inch of thickness. Fir, pine and similar woods have an R value of about 1.25 per inch of thickness. Hardboard has an R value of about 1.37 per inch of thickness. Oriented strand board has an R value of about 0.45, 0.51, 0.62, 0.74 and 0.91 for nominal panel thicknesses of 3/8 inches, 7/16 inches, 1/2 inches, 5/8 inches and 3/4 inches, respectively. The thermal resistance R is measured in units of (feet$^2$ X hour X degrees Fahrenheit)/Btu. As to R values, the book Superinsulated Home Book, authored by J. D. Ned Nisson and Michael L. Webb, copyright 1985, published by John Wiley & Sons, New York, is hereby incorporated by reference in its entirety. Each of the present 1.3 inch thick wall panels 120 and 128 has an R value of at least 1.5.

As to the sandwich wall panel 120, the outer two layers 122 and 124 may be laminated to the inner layer or core 126 with the type of resin used in the oriented strand board. Or the three layers 122, 124 and 126 may be laminated together with ordinary wood glue.

Each of the layers 122, 124 and 126 includes its own sublayers of oriented wood strands. Each of the layers 122, 124 and 126 may have an aligned face and random core lay-up or may have an aligned face and oriented core lay-up.

Each of the layers 122, 124 and 126 may be of equal thickness, or the layers 122, 124 and 126 may be of different thicknesses. It is preferred that that the outer layers 122 and 124 have the same thicknesses and that the inner layer 126 has a greater or lesser thickness, and it is more preferred that the inner layer has a greater thickness. It is most preferred that each of the layers 122, 124 and 126 are of the same thickness.

Figure 9A:
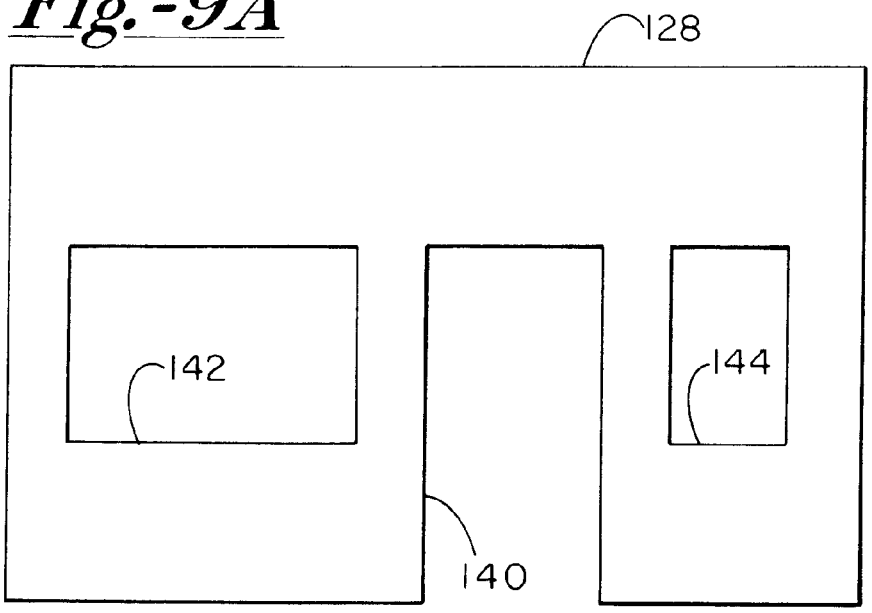
FIG. 9A is an elevation view of either of the sandwich wall panel or integral wall panel having door and window openings.
Figure 10:
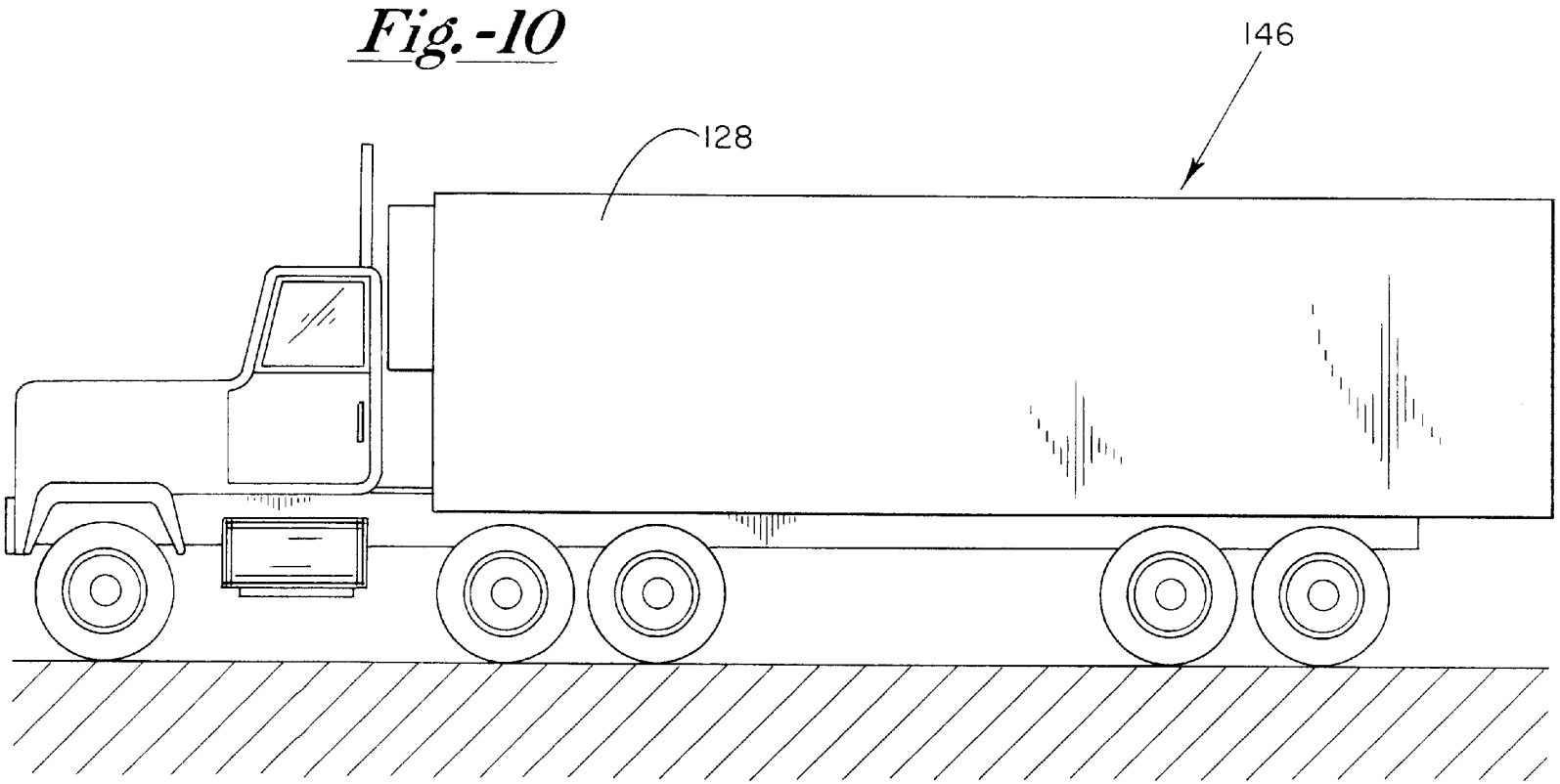
FIG. 10 is a perspective view of a tractor-trailer hauling the panels of the present invention from the factory site to the building site.

FIG. 9A shows an integral wall panel 128 having a door cut out 140, a picture window cut out 142, and bedroom window cut outs 144. Cut outs 140, 142 and 144 are formed at the factory and then the wall panels 128 as a whole are shipped to the building site, such as on a tractor-trailer 146 shown in FIG. 10. Cut outs 140, 142 and 144 may be formed in sandwich panel 120. The sandwich wall panel 120 may include such cut outs 140, 142 and 144.

Figure 9B:
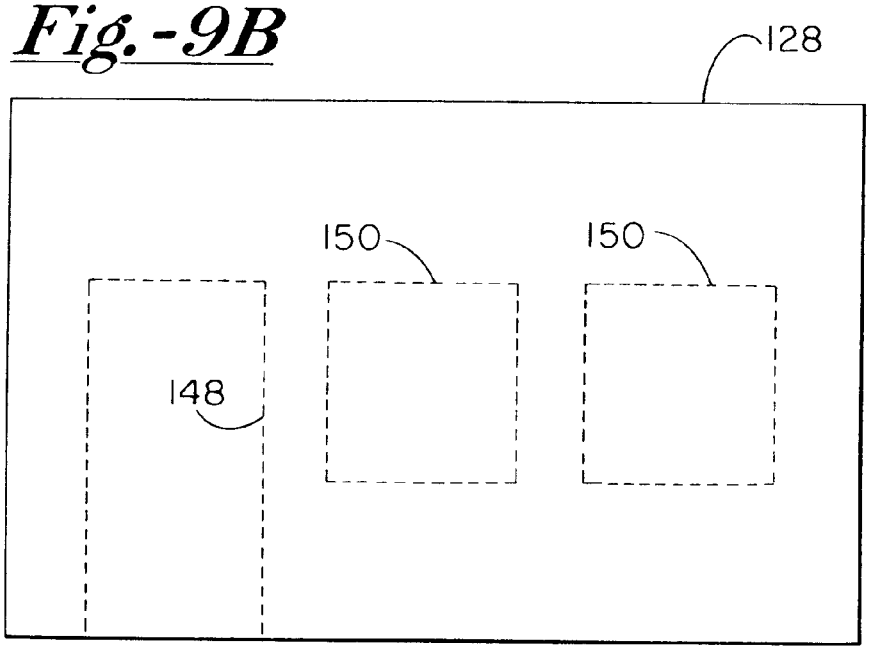
FIG. 9B is an elevation view of either of the sandwich wall panel or integral wall panel having indicia for cutting out door and window openings on site.

FIG. 9B shows an integral wall panel 128 being marked for being cut in the field.

Marking 148 shows a door opening to be cut and markings 150 show window openings to be cut. The sandwich wall panel 120 may include such markings 148 and 150.

As an alternative to the cutouts of FIG. 9A and to the markings of FIG. 9B, a template may be shipped with the panels 120 and 128. The templates may include slots or guides for door openings, window openings and other openings. The template may be formed of a flexible material such as sheeting or may be formed of a more rigid material such as oriented strand board.

FIG. 11 A shows a studless, superinsulated home 170. House 170 for illustration purposes shows both the integral relatively thick structural wall panel 128 and the networked integral wall panel (i.e. wall panel 20, 2, 24, or 26). If desired, the sandwich wall panels 120 may be used in place of the networked wall panels 20, 22, 24, 26 or the relatively thick panel 128.

Other features of the generally airtight home 170 are seals 172 between the sill plate and foundation wall, seals 174 between the frame of a window and a frame of the house 170, seals 176 around the frame of a door and the frame of the house 170, seals 178 at the sole plate-subfloor junction, seals 180 at the junctions of the wall panels 120 or 128, seals 182 between the wall panels 120 or 128 and the ceilings, seals 184 where the pipes penetrate the walls 120 or 128 or floor or ceiling panel, seals 186 where the electric, telephone, TV, and computer cables penetrate wall panels 120 or 128 or floor or ceiling panel. Such seals 172, 174, 176, 178, 180, 182, 184 and 186 may be an expanding foam which permanently fills openings, batts of insulation, caulking or double rows of caulking, or shims.

The house 170 is insulated. Insulation 188 confronts the exterior face of the wall panels 120 or 128 (see FIGS. 12A and 12B), in the attic on top of the ceilings of the house 170 (see FIG. 11B), and below the floorboards. As indicated above, with the studless wall panels 120 and 128 of the present invention, it is relatively easy to cover such a flat wall panel with insulation. With a flat wall, insulation voids are minimized. It should be noted that insulation 188 may be rock or slag wool, fiberglass, cellulose, polystyrene foam, polyurethane foam, polyisocyanurate foam, perlite, vermiculite or any other insulative material having a nominal R value per inch of thickness of about 1.5 to about 10 or more.

An optional feature of the generally airtight house 170 is a wall vapor barrier 190. As shown best in FIG. 12B, water vapor barrier 190 may be disposed on the inside face of wall panels 20, 22, 24, 26, 120 or 128 so as to be disposed between such wall panel and drywall or sheet rock. The vapor barrier 190 may be a plastic sheeting, such as a polyethylene sheeting, or a metallic sheeting. The vapor barrier is a barrier to both air and water vapor. The entire inside face of wall panel 20, 22, 24, 26, 120 or 128 is lined with such a vapor barrier 190 and such a plastic water vapor barrier may run integrally from wall panel 20 to wall panel 22 to wall panel 24 to wall panel 26 (or between adjacent wall panels 120 or between adjacent wall panels 128).

It should be noted that the wall panels 20, 22, 24, 26, 120 and 128 minimize or eliminate the need for such wall plastic sheeting 190. Further, floorboards 191 and roof sheathing 193, when formed of a material such as oriented strand board that is both structural and includes a low permeance value, minimize or eliminate the need for a lower (floor or basement or crawl space) layer of polyethylene sheeting and upper (roof) layer of polyethylene sheeting. Floorboards 191 and roof sheathing 193 preferably have a vapor permeance value of between about 0.05 perms and 2.55 perms, more preferably between about 0.05 perms and 2.0 perms, and most preferably between about 0.05 perms and 1.95 perms. The thickness of the floorboards 191 and roof sheathing 193 is preferably between about $7/16^{th}$ inches and about 1.25 inches. Floorboards 191 are more preferably about ¾ inches and roof sheathing 193 are more preferably about 15/32 inches. Such wall panels 20, 22, 24, 26, 120 and 128, floorboards 191 and roof sheathing 193 make a general first "bubble" for the house and plastic sheeting about the roof, walls and basement (or crawl space or floor) make a second "bubble" for the house 170.

In other words, the inclusion of wall panels 20, 22, 24, 26, 120 or 128 is merely one feature of the generally airtight home 170. Another feature of the airtight home 170 is the inclusion of structural floor panels 191 formed of oriented strand board panels about 7/16 inch thick and having a water vapor permeance value of about 1.95 perms. Flooring panels 191 run to and between wall panels 20, 22, 24, 26, 120 and 128. The set of flooring panels 191 is a first water vapor barrier at the general floor location. A polyethylene sheet 194, wrapping a crawl space 195 and engaged on foundation walls 80 and underneath the concrete 196 poured for the base of the house 170, is a second—but optional—water vapor barrier at the floor location.

Figures 11A, 11B:
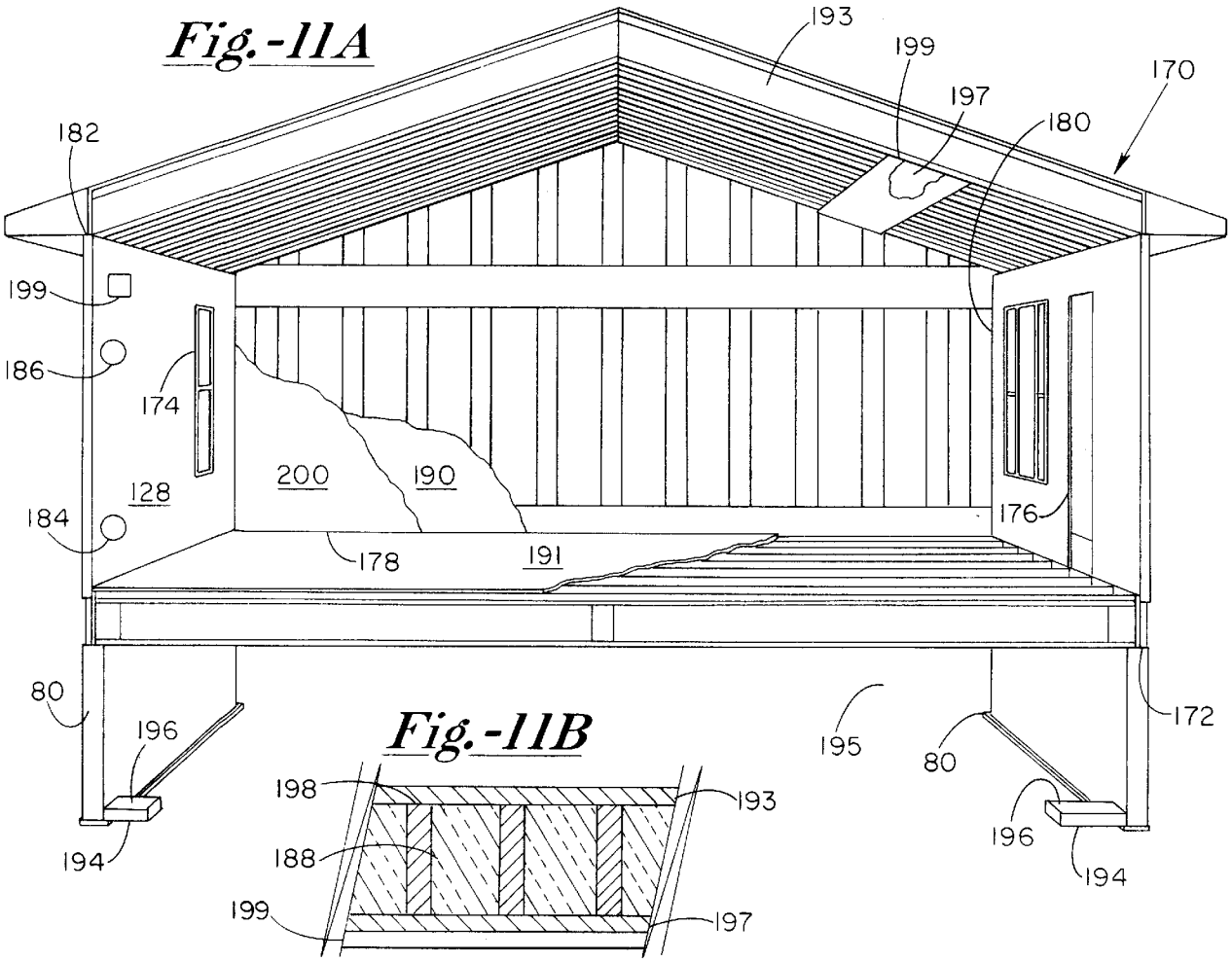
FIG. 11A shows a cut-way of a house similar to the house of FIG. 1 and shows how the interior of such a house, having a wall panel of any of the embodiments, is generally impervious to water vapor with oriented strand board sheathing for the floor and roof as well as the wall panel.
FIG. 11B shows a partial section view of the roof of the house of FIG. 1.

Another feature of the airtight home 170 is the inclusion of the roof sheathing 193 formed of oriented strand board panels about 15/32 thick or about $7/16^{th}$ inches thick and having a water vapor permeance value of about 1.95 perms. Roof sheathing 193, like floor panels 191, run to and between wall panels 20, 22, 24, 26, 120 and 128, in an oblique direction up and over the apex of the roof. The set of panels making up the roof sheathing 193 is a first water vapor barrier at the roof location. A polyethylene sheet 197, as best shown in FIG. 11B, is tacked or otherwise engaged to the roof beams 198 between sheet rock 199 and beams 198. Insulation 188 is disposed between the beams 198 and between the polyethylene sheeting 197 and the roof sheathing 193.

As indicated above, house 170 includes a pair of thermal envelopes or plastic bubbles. One envelope is provided by the combination of 1) the wall panels 20, 22, 24, 26 (or wall panel 120 or wall panel 128), 2) the floor sheathing 191, and 3) the roof sheathing 193. Another thermal envelope or bubble is provided by the combination of 1) the wall polyethylene vapor barrier 190, 2) the floor or crawl space or basement polyethylene vapor barrier 194, and 3) the roof polyethylene vapor barrier 197.

It should be noted that the panels making up the floor sheathing 191 and roof sheathing 193 may not be perfectly sealed relative to each other. However, these panels preferably include tongue and groove fittings. Such fittings provide a tortuous path for the escape of water vapor and air. Further, it is preferred that such joints or fittings include glue which acts as a sealant. As to such tongue and groove fittings, U.S. patent application Ser. No. 08/794,429 filed Feb. 5, 1997 entitled Building Jig and Box Beam Therefor is hereby incorporated by reference in its entirety.

Since floor sheathing 191 and roof sheathing 193 provide less than perfect water vapor barriers, one embodiment of a preferred house of the present invention is to keep the lower polyethylene sheeting 194 and upper polyethylene sheeting 197 and eliminate the wall polyethylene sheeting 190. Still further preferred is to include wall polyethylene sheeting 190 so that house 10 or house 170 includes two thermal envelopes, one provided by an easily torn but highly impermeably plastic such as polyethylene and the other provided by the structural panels of, preferably, oriented strand board.

Preferably, both primary spaces and secondary spaces are wrapped by both thermal envelopes of the present invention. Primary spaces include living rooms, bedrooms, kitchens and dens. Secondary spaces include attics, crawl spaces, basements and garages. As indicated above, any material with a permeance of less than 0.1 perms is considered to be a vapor retarder or vapor barrier for a superinsulated house. However, as indicted above, it has been found that providing a structural vapor barrier is in practice a more effective water vapor barrier than polyethylene, even though the structural water vapor may have a permeance value of 1.95 perms (such as 7/16 inches or one-half inch thick oriented strand board), because a structural water vapor barrier cannot be torn.

House 170 is ventilated (intentional air flow) and preferably includes a fan or blower 199. Blower 199 preferably includes a heat exchanger.

Figure 12A:
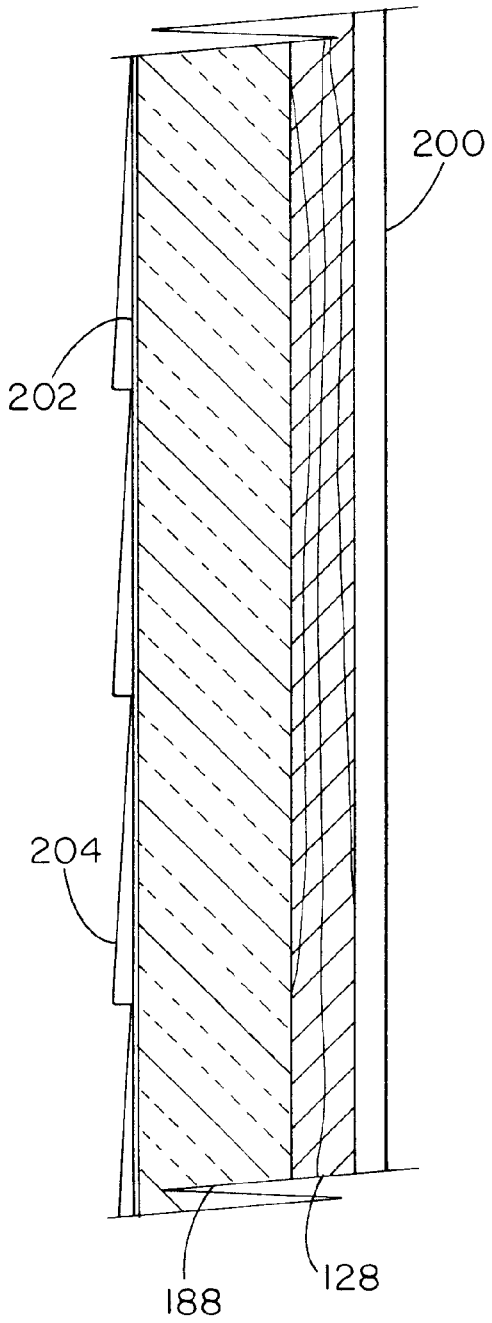
FIG. 12A shows a section of any one of the front, rear or side walls of the house of FIG. 1 and indicates that the house of FIG. 1 does not require water vapor barrier.

FIG. 12A shows a cross section of any of the walls of the house of FIG. 11 having the integral wall panel 128 (or wall panel 20, 22, 24, 26, or sandwich wall panel 120) without polyethylene sheeting. From the inside out, such wall includes sheet rock 200, wall panel 128 (or wall panel 20, 22, 24, 26, or sandwich panel 120), insulation 188, an air barrier 202, and siding 204. Since the integral wall panel 128 acts as a vapor barrier itself, the vapor barrier 190 is optional. The air barrier 202 is also optional. The air barrier 202 blocks air flow, but permits water vapor to pass through. The air barrier 202 prevents air intrusion into the insulation 188 and compensates for minor imperfections in one or both of the sheeting vapor barrier 190 or the vapor barrier wall panel 128. The air barrier 202 may be a spun-bonded polyethylene such as DuPont's Tyvek®.

Figure 12B:
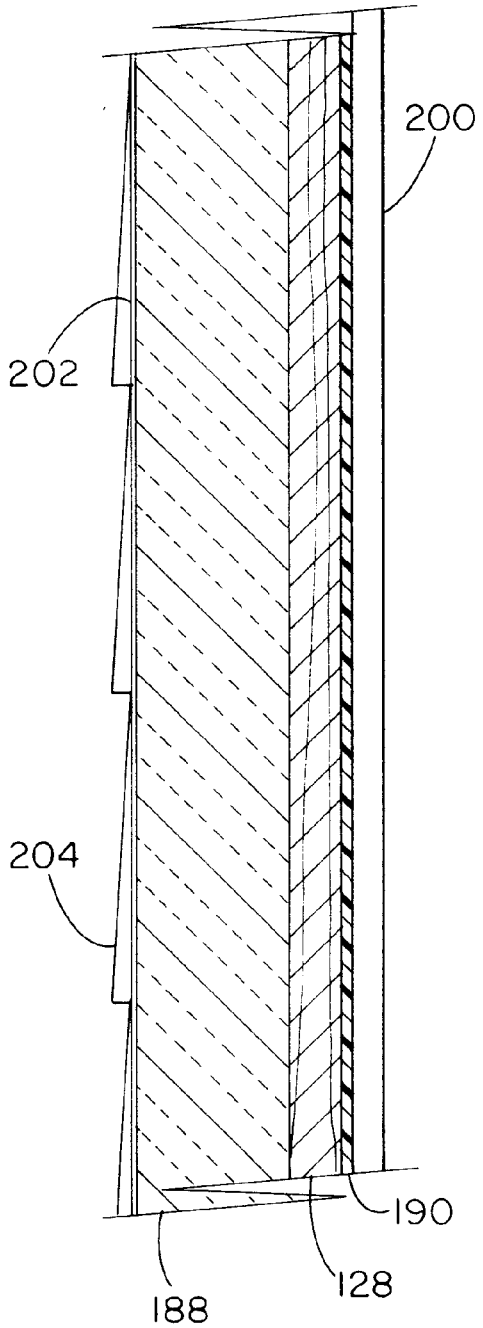
FIG. 12B shows a section of a wall similar to the section shown in FIG. 12A but includes the optional water vapor barrier.

FIG. 12B shows a cross section of any of the walls of the house of FIG. 11 having the integral wall panel 128 (or wall panel 20, 22, 24, 26, or sandwich panel 120) with the polyethylene water vapor barrier 190. From the inside out, such wall includes sheet rock 200, the polyethylene water vapor barrier 190 tacked to or otherwise engaged to the wall panel, wall panel 128 (or wall panel 20, 22, 24, 26, or sandwich panel 120), insulation 188, an air barrier 202, and siding 204.

As to the features of a superinsulated home, the book Superinsulated Home Book, authored by J. D. Ned Nisson and Michael L. Webb, copyright 1985, published by John Wiley & Sons, New York, is hereby incorporated by reference in its entirety.

As to oriented strand board, the chapter "Composition Board," *Encyclopedia of Polymer Science and Engineering*, 1986, pp. 47–67, Volume 4, John Wiley & Sons, New York, is hereby incorporated by reference in its entirety. Further as to oriented strand board, the chapter "Wood," *Encyclopedia of Polymer Science and Engineering*, 1989, pp. 843–887, Volume 17, John Wiley & Sons, New York, is hereby incorporated by reference in its entirety.

Oriented strand board is an engineered mat-formed structural panel made of strands sliced from small diameter logs, and bonded with resin under intense heat and pressure. Since the strands are precisely cut to a uniform size and thickness, specific performance qualities can be designed into the panel by cross-aligning layers of wood strands for maximum length. Oriented strand board formed with an aligned face and a random core or an aligned face with a oriented core is preferred. The resin is fully waterproof, and is preferably a waterproof phenolic resin. Oriented strand board possesses great strength and stiffness resulting from the cross-laminated layers. Oriented strand board will not warp. The preferred oriented strand board is manufactured to Exposure I and Structural I standards. Oriented strand board is not "particle board." Neither is it "flakeboard." Oriented strand board meets performance standards based on the end use for the board. The three basic criteria for qualifying oriented strand board include structural adequacy, dimensional stability and bond durability. Tests for such criteria include linear expansion, racking, uniform load, concentrated static load, impact resistance, direct fastener withdrawal, and lateral fastener strength. Oriented strand board panels are strong. Such panels resist racking and shape distortion under high wind and earthquake forces. Such panels exhibit excellent fastener-holding capability, even when nailed close to the panel edge. Relative to its strength, oriented strand board is lightweight. Such panels have stiffness to resist deflection and bending. They absorb shock. They are made from wood, a natural insulator, and provide protection from heat loss and condensation.

Oriented strand board is a generic structural panel product composed of strands sliced from whole aspen poplar, southern yellow pin or other mixed hardwood logs. The strands are sliced from the logs in the direction of the grain so that the inherent tree strength is maintained in the oriented strand board panel. After slicing, the strands are dried, blended with wax and waterproof exterior type binders such as phenolic resin, then formed into a loose mat or pad containing three to five layers and then pressed under high pressure and heat in the final rigid, dense structural panel, which then may be cut to size. The binder is preferably waterproof and boilproof The strands are oriented in layers during the forming process so that strands on the panel surface generally lay in the direction of the panel's strength. The inner layers, generally consisting of three to five layers for each of the discrete panels 122, 124 and 126 of sandwich wall panel 120, may be randomly oriented and/or cross aligned. The longitudinal arrangement of the strands in the surface layers increases the strength and stiffness of the panel in the direction of alignment.

Strands for oriented strand board may be up to four and a quarter inch in length and one inch wide. Strands preferably have a uniform thickness.

The strength of oriented strand board is provided by the uninterrupted wood fiber, interleaving of the long strands, and the degree of orientation of the strands in the surface layers. Waterproof and boilproof resin binders further provide internal strength, rigidity and moisture resistance.

Figure 13A:
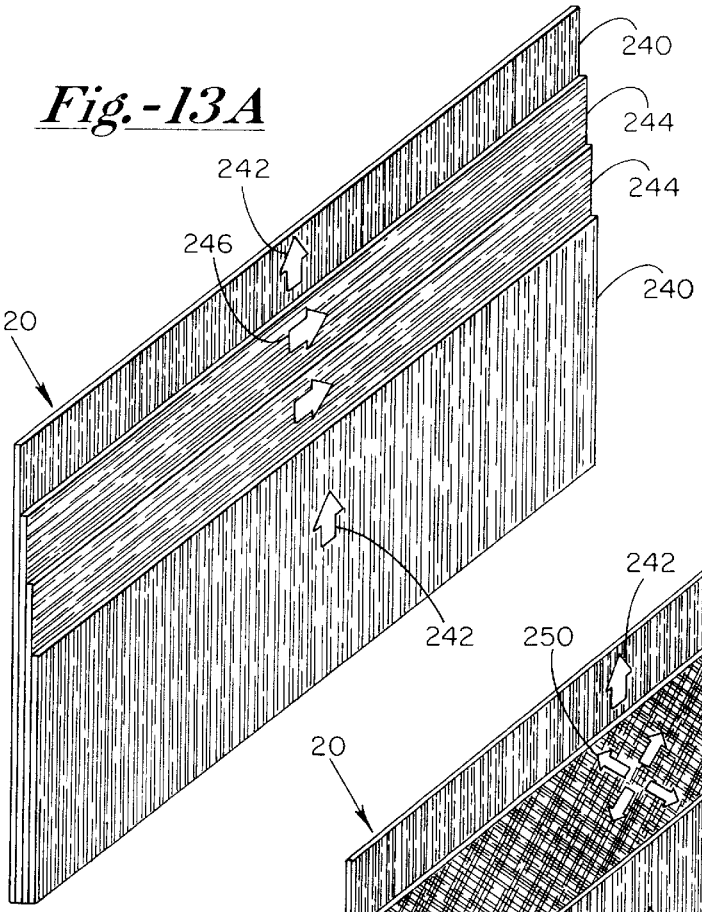
FIG. 13A shows a partial view of a panel of oriented strand board and shows aligned face sublayers and an oriented core sublayer.
Figure 13B:
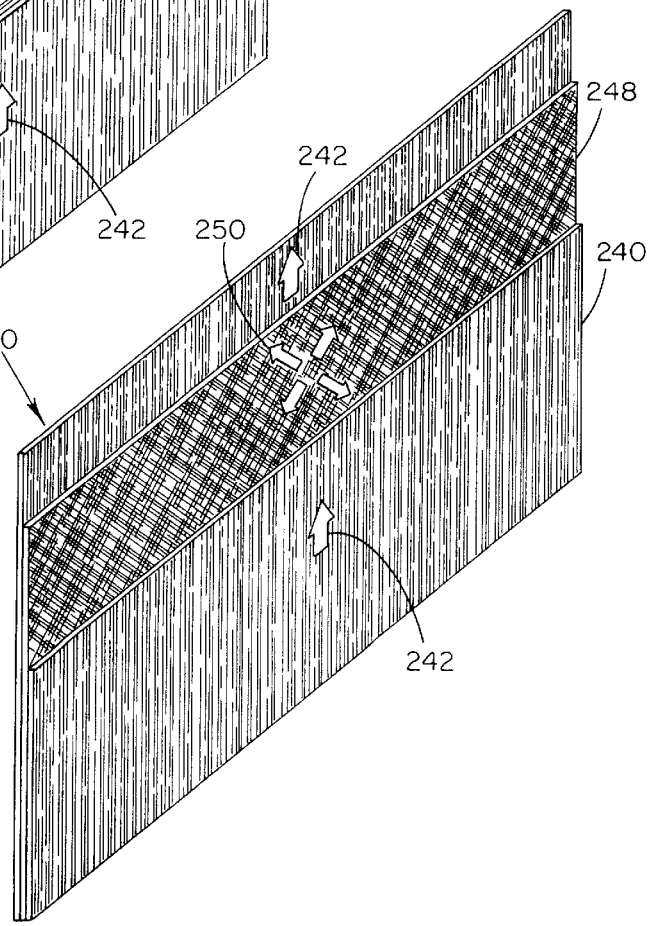
FIG. 13B shows a partial view of a panel of oriented strand board and shows aligned face sublayers and a random core sublayer.

The sublayers of wood strands which form a panel of oriented strand board are shown in exaggerated form in FIGS. 13A and 13B. FIG. 13A shows oriented strand board with aligned faces and an oriented core. FIG. 13B shows oriented strand board with aligned faces and a random core. In FIGS. 13A and 13B, reference numeral 240 indicates the aligned face layers with reference arrow 242 indicating the longitudinal direction of alignment of the wood strands. In FIG. 13A, reference numeral 244 indicates the oriented core layers with reference arrow 246 indicating the lateral direction of alignment of the wood strands. In FIG. 13B, reference numeral 248 indicates the random core layers with reference arrow 250 indicating the random direction of orientation of the wood strands.

The panels shown in FIG. 13A and 13B are designated as face wall panel 122, which forms the face layer of the sandwich wall panel 120. However, the panels of FIG. 13A and 13B may also serve as the other face panel 124 or as the core panel 126. Or the panels of FIGS. 13A.and 13B may serve as one of the wall panels 20, 22, 24, and 26 or as the integral wall panel 128. In the case where such panel is the integral wall panel 128, the number of face sublayers 242 preferably outnumber the core sublayers 244 or 248. Face sublayers are oriented generally vertically and provide for a greater vertical loading capacity.

Preferably, when in house 170 and utilizing an arrangement having aligned core sublayers 244 of FIG. 13A, wall panels 20, 22, 24, 26, 120 and 128 are disposed with the directional arrows 242 (of the face sublayers) extending in the vertical direction for maximum strength. In this orientation, the wood strands of the aligned core sublayers 244 extend in the horizontal direction.

Preferably, when in house 170 and utilizing an arrangement having the random core sublayers 250 of FIG. 13B, wall panels 20, 22, 24, 26, 120 and 128 are disposed with the directional arrows 242 (of the face sublayers) running generally vertically. In this orientation, the wood strands of the random core sublayers 250 run transversely to the vertical direction.

It should be noted that the face sublayers of the panels (i.e., the header 50, the baseboard 52, firring strips 54) of the support network 46 have wood strands or directional arrows 242 running generally in the vertical direction.

As to methods of construction for houses having oriented strand board components, the following documents are hereby incorporated by reference in their entireties: U.S.

patent application Ser. No. 08/794,429 filed Feb. 5, 1997 and entitled Building Jig and Box Beam Therefor, U.S. patent application Ser. No. 08/796,667 filed Feb. 5, 1997 and entitled Prefabricated Wall Partition Arrangement, and U.S. Pat. No. 5,351,453 issued Oct. 4, 1994 and entitled Rapidly Erectable Housing Units.

As to the one material for said wall panel 20, 22, 24, 26, 120 or 128, this one material consists essentially of preferably organic matter, more preferably wood, and most preferably oriented strand board. Organic matter includes wood, straw, or soybean products.

It should be noted that to receive and hold a pin connector means that the pin connector, such as a nail, staple or screw used in residential home construction, has a minimum lateral and withdrawal resistance preferably about that equal to plywood. More preferably, a nail, staple or screw in a dry panel 20, 22, 24, 26, 120 or 128 has a minimum ultimate lateral loading of about 120 pounds and a minimum withdrawal loading of about 20 pounds. In other words, as to lateral loading, a conventional nail, screw or staple when in one of the panels 20, 22, 24, 26, 120, or 128 retains its integrity and the portion of such panel about such a pin connector also retains its integrity when a lateral load of about 120 pounds is applied to the pin connector. As to withdrawal resistance, a conventional nail screw or staple remains in its respective panel 20, 22, 24, 26, 120 or 128 when a withdrawal load of about 20 pounds is applied to the nail, screw or staple.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalents of the claims are intended to be embraced therein.

What is claimed is:

1. A residential house, comprising, in combination:

a) a base;

b) a roof;

c) at least four corners;

d) wall panels enclosing the house and being disposed between the base and the roof, with each of the wall panels comprising, in combination:

i) first and second faces, with the distance between the first face and the second face defining a thickness of the wall panel;

ii) upper and lower edges, with the upper and lower edges defining a height, with the height being at least as great as an average adult male;

iii) first and second end edges, with the first and second end edges defining a length, with the length being equal to or greater than the height;

iv) wherein said wall panel includes a vertical load strength between the upper and lower edges, with the vertical load strength being sufficient to transmit live loads between the roof and the base, with the live loads being transmittable at generally any portion along the upper and lower edges;

v) wherein said wall panel is integral and one piece;

vi) wherein said wall panel consists essentially of one material, with the one material comprising organic material, with the one material at said thickness having a water vapor permeance value of between about 0.05 perms and 2.0 perms, wherein the one material is oriented strand board; and vii) wherein said wall panel is capable of receiving and holding a pin connector at any location between the upper and lower edges and end edges where said one material is present, wherein the pin connector is selected from the group of pin connectors consisting of nail pin connectors, staple pin connectors and screw pin connectors used in residential home construction;

e) floorboards and roof sheathing, with the floorboards and roof sheathing comprising oriented strand board such that a living area in the house is enveloped by oriented strand board, thereby providing a structural and first thermal bubble for the house; and f) a plastic water vapor barrier engaged adjacent to said wall panels, roof and base, thereby providing a plastic and second thermal bubble for the house.

2. The house according to claim 1 wherein the wall panel has a thickness between about $7/16^{th}$ inches and about 12 inches.

3. The house according to claim 1 wherein the wall panel is studless.

4. The house according to claim 1 wherein the wall panel is itself a stud.

5. The house according to claim 1, wherein at least one of said wall panels runs from one of the corners to another of the corners.

6. The house according to claim 1, wherein each of the four corners is formed at least in part by one of said wall panels.

7. The house according to claim 1, wherein the house includes a window opening and a door opening, and wherein said openings are formed in one of said wall panels.

8. The house according to claim 1, wherein said wall panel includes a length between about 12 and about 60 feet.

9. The house according to claim 1, wherein said wall panel includes a length between about 20 and about 50 feet.

10. The house according to claim 1, wherein the house is sealed so as to be substantially airtight, and further comprising a blower to positively ventilate the house.

11. The house according to claim 1 wherein the said wall panel has a thickness between 1.3 inches and about 12 inches, with said one material at said thickness having a water vapor permeance value of between about 0.05 perm and about 0.5 perm.

12. The house according to claim 11 wherein said wall panel includes one discrete layer of oriented strand board.

13. A residential house, comprising, in combination:

a) a base;

b) a roof;

c) at least four corners;

d) wall panels enclosing the house and being disposed between the base and the roof, with each of the wall panels comprising, in combination:

i) first and second faces, with the distance between the first face and the second face defining a thickness of the wall panel, with the thickness being at least about $7/16^{th}$ of an inch and less than about 12 inches;

ii) upper and lower edges, with the upper and lower edges defining a height, with the height being at least as great as an average adult male;

iii) first and second end edges, with the first and second end edges defining a length, with the length being equal to or greater than the height, with the length being between about 12 feet and about 60 feet;

iv) wherein the wall panel includes a vertical load strength between the upper and lower edges, with the wall panel transmitting live loads between the upper and lower edges so as to transmit live loads between the roof and the base, with the live loads being transmittable at generally any portion along the upper and lower edges;

v) wherein the wall panel is integral and one piece;

vi) wherein the wall panel consists essentially of oriented strand board, wherein the oriented strand board comprises sublayers of pressed wood strands, wherein the sublayers comprise face sublayers and core sublayers, with the wood strands in the face sublayers being oriented generally vertically, with the oriented strand board at said thickness having a water vapor permeance value of about 0.05 perms and about 2.0 perms; and vii) wherein the wall panel is capable of receiving and holding a pin connector at any location between the upper and lower edges and end edges where said one material is present, wherein the pin connector is selected from the group of pin connectors consisting of nail pin connectors, staple pin connectors and screw pin connectors used in residential home construction;

e) wherein the house further comprises floorboards and roof sheathing, with the floorboards and roof sheathing comprising oriented strand board such that a living area in the house is enveloped by oriented strand board, thereby providing a structural and first thermal bubble for the house; and f) wherein the house further comprises a positive ventilator to provide the house with positive air flow.

* * * * *